US012357894B2

(12) United States Patent
Lee

(10) Patent No.: US 12,357,894 B2
(45) Date of Patent: Jul. 15, 2025

(54) BICYCLE SIMULATOR

(71) Applicant: REAL DESIGN TECH CO., LTD., Gyeonggi-do (KR)

(72) Inventor: Joong Sik Lee, Gyeonggi-do (KR)

(73) Assignee: REAL DESIGN TECH CO., LTD., Gyeonggi-do (KR)

( * ) Notice: Subject to any disclaimer, the term of this patent is extended or adjusted under 35 U.S.C. 154(b) by 451 days.

(21) Appl. No.: 17/640,079

(22) PCT Filed: Aug. 31, 2020

(86) PCT No.: PCT/KR2020/011613
§ 371 (c)(1),
(2) Date: Mar. 3, 2022

(87) PCT Pub. No.: WO2021/045458
PCT Pub. Date: Mar. 11, 2021

(65) Prior Publication Data

US 2022/0323823 A1 Oct. 13, 2022

(30) Foreign Application Priority Data

Sep. 3, 2019 (KR) ..... 10-2019-0108933
Jan. 6, 2020 (KR) ..... 10-2020-0001568

(51) Int. Cl.
*A63B 22/02* (2006.01)
*A63B 69/16* (2006.01)
(Continued)

(52) U.S. Cl.
CPC ..... *A63B 69/16* (2013.01); *A63B 2024/009* (2013.01); *A63B 2069/166* (2013.01); *A63B 2071/0638* (2013.01)

(58) Field of Classification Search
None
See application file for complete search history.

(56) References Cited

U.S. PATENT DOCUMENTS 2,803,349 A * 8/1957 Talbot ..... B62H 3/10 24/535
2,805,860 A * 9/1957 Littig ..... A63B 69/16 482/61
(Continued)

FOREIGN PATENT DOCUMENTS

CO 2019003436 A1 5/2019
DE 104349 7/1899
(Continued)

OTHER PUBLICATIONS

First Office Action for Chinese Application No. 2020-80061667.6 (13 pages) and English translation (5 pages), mailed Sep. 22, 2022.
(Continued)

*Primary Examiner* — Shila Jalalzadeh Abyaneh
(74) *Attorney, Agent, or Firm* — Guntin & Gust, PLC; Miyoung Shin

(57) ABSTRACT

A bicycle simulator includes a base portion having a frame shape; a frame support portion supported by the base portion and supporting a bicycle frame connecting a front wheel of a mounted bicycle to a rear wheel of the mounted bicycle; a first treadmill extending in a running direction of the bicycle, supporting the front wheel of the bicycle, and rotating according to rotation of the front wheel; and a second treadmill extending in the running direction of the bicycle, supporting the rear wheel of the bicycle, and rotating according to rotation of the rear wheel, wherein the frame support portion is disposed between the first treadmill and the second treadmill.

4 Claims, 24 Drawing Sheets

(51) Int. Cl.
*A63B 24/00* (2006.01)
*A63B 71/06* (2006.01)

(56) References Cited

U.S. PATENT DOCUMENTS

| | | | | | |
|---|---|---|---|---|---|
| 4,415,152 | A * | 11/1983 | Smith | A63B 26/003 482/61 |
| 4,750,737 | A * | 6/1988 | Smith | A63B 69/16 482/61 |
| 4,826,150 | A * | 5/1989 | Minoura | A63B 21/0051 482/61 |
| 4,925,183 | A * | 5/1990 | Kim | A63B 69/16 482/61 |
| 4,932,651 | A * | 6/1990 | Defaux | A63B 69/16 482/61 |
| 4,958,832 | A * | 9/1990 | Kim | A63B 22/16 482/61 |
| 5,492,516 | A | 2/1996 | Trotter | |
| 2011/0218080 | A1* | 9/2011 | Papadopoulos | B62H 1/12 482/61 |
| 2012/0238412 | A1* | 9/2012 | Hamilton | A63B 24/0087 482/61 |
| 2014/0066264 | A1* | 3/2014 | Haddon | A63B 22/0235 482/61 |
| 2017/0189778 | A1* | 7/2017 | Kimura | A63B 69/16 |
| 2017/0246524 | A1 | 8/2017 | Zapirain Elosegui | |
| 2018/0036619 | A1* | 2/2018 | Kim | A63B 22/02 |
| 2019/0070476 | A1* | 3/2019 | Bass | A63B 21/005 |

FOREIGN PATENT DOCUMENTS

| | | | | |
|---|---|---|---|---|
| FR | 2636587 | A1 * | 3/1990 | |
| JP | H11197267 | A * | 7/1999 | |
| JP | 2002251128 | A | 9/2002 | |
| KR | 100755787 | B1 * | 9/2007 | |
| KR | 20120018973 | A * | 3/2012 | |
| KR | 1020120117104 | A | 10/2012 | |
| KR | 101249826 | B1 | 4/2013 | |
| KR | 1338634 | B1 * | 12/2013 | A63B 69/16 |
| KR | 1020160090003 | A | 7/2016 | |
| KR | 101780743 | * | 9/2017 | |
| KR | 101780743 | B1 * | 9/2017 | |
| KR | 101827306 | B1 | 2/2018 | |
| KR | 1020180083078 | A | 7/2018 | |
| WO | 2020208497 | A1 | 10/2020 | |

OTHER PUBLICATIONS

Japanese Office Action of Counterpart Japanese Application No. 2022-514475 and English translation, mailed Mar. 9, 2023 (6 pages).

International Search Report for corresponding International Application No. PCT/KR2020/011613, mailed Dec. 2, 2020, 11 pages.

"Database EPODOC, European Patent Office, The Hague, NL, May 10, 2019 , XP002809834, Database accession No. CO-2019003436-A," 2 Pages [See WO 2020/208497 for the whole document].

"Supplementary Partial European Search Report for Corresponding European Patent Application No. 20860197.1", Aug. 10, 2023, 14 Pages.

* cited by examiner

BICYCLE SIMULATOR

TECHNICAL FIELD

The disclosure relates to a bicycle simulator for virtual riding, and more particularly, to a bicycle simulator for virtually experiencing various riding paths in an indoor space and enjoying exercise effects.

BACKGROUND ART

In general, bicycle exercise equipment called a bicycle trainer or a bicycle roller is the most widely used indoor exercise equipment along with a treadmill and increases lower body strength in a manner in which a rider riding a bicycle mounted on a rotating roller or a cradle uses pedals to rotate wheels to which rotational resistance force (magnetic force, etc.) is applied.

Such conventional bicycle exercise equipment may provide a fairly high exercise effect to the rider even with a relatively short time of exercise, through adjustment of the rotational resistance force applied to the wheels regardless of the weather.

However, because conventional bicycle exercise equipment only continues a pedaling exercise in which rotational resistance force is applied while facing a wall, etc. in an enclosed indoor space, the rider may not have pleasure of actual riding a bicycle at all. Thus, due to the boredom or loss of interest, there has been a problem in which it is difficult for the rider to sustain a continuous pedaling exercise.

DESCRIPTION OF EMBODIMENTS

Technical Problem

The disclosure is to provide a bicycle simulator in which a dynamic experience extremely similar to an actual riding situation may be achieved by realizing a flat riding state using a treadmill and various driving modes for implementing left and right steering, acceleration, and deceleration of bicycle riding.

Solution to Problem

A bicycle simulator according to an embodiment of the disclosure includes a base portion having a frame shape; a frame support portion supported by the base portion and supporting a bicycle frame connecting a front wheel of a mounted bicycle to a rear wheel of the mounted bicycle; a first treadmill extending in a running direction of the bicycle, supporting the front wheel of the bicycle, and rotating according to rotation of the front wheel; and a second treadmill extending in the running direction of the bicycle, supporting the rear wheel of the bicycle, and rotating according to rotation of the rear wheel, wherein the frame support portion is disposed between the first treadmill and the second treadmill.

The bicycle simulator may further include a first slide guide fixed to the base portion and extending in the running direction of the bicycle; and a first slide portion supported by the frame support portion and connected to the first slide guide to be slidable in the running direction of the bicycle in the first slide guide.

The first treadmill may include a plurality of first roller portions disposed to be apart from each other with a certain interval therebetween in the running direction of the bicycle; and a first belt disposed to surround outer circumferential surfaces of the plurality of first roller portions.

The bicycle simulator may further include a plurality of first lifting portions disposed on each of the plurality of first roller portions, wherein the plurality of first lifting portions may be disposed at both ends of the first roller portion and move the first roller portion up and down in a vertical direction perpendicular to the running direction of the bicycle.

The second treadmill may include a plurality of second roller portions disposed to be apart from each other with a certain interval therebetween in the running direction of the bicycle; and a second belt disposed to surround outer circumferential surfaces of the plurality of second roller portions.

The bicycle simulator may further include a plurality of second lifting portions disposed on each of the plurality of second roller portions, wherein the plurality of second lifting portions may be disposed at both ends of the second roller portion and move the second roller portion up and down in a vertical direction perpendicular to the running direction of the bicycle.

The bicycle simulator may further include a display device that visually provides a certain riding environment to a rider on the bicycle; and a controller that controls driving of the plurality of first lifting portions and the plurality of second lifting portions, wherein the controller may raise or lower each of the plurality of first roller portions and the plurality of second roller portions to match a riding environment provided in real time through the display device.

The bicycle simulator may further include an elastic member having one end supported by the base portion and the other end supported by the first slide portion, wherein the elastic member may be tensioned as the bicycle moves forward in the running direction of the bicycle.

The bicycle simulator may further include a damper member having one end supported by the base portion and the other end supported by the first slide portion, wherein the damper member may decelerate a moving speed of the bicycle when the bicycle moves backward in the running direction of the bicycle by an elastic force of the elastic member.

The bicycle simulator may further include a second slide guide supported by the base portion and extending in a left-right direction perpendicular to the running direction of the bicycle; and a second slide portion fixed to the frame support portion and connected to be movable in the left-right direction in the second slide guide.

A frame support module according to an embodiment of the disclosure includes a frame base including a frame and a side support portion disposed on a side surface of the frame; a support bar extending in one direction and supported by the frame base; and a support clamp disposed at one end of the support bar and supporting a bicycle frame connecting a front wheel of a mounted bicycle to a rear wheel of the mounted bicycle.

The frame support module may further include a third slide guide disposed on both side portions of the frame base and extending in a running direction of the bicycle; and a third slide portion supported by the support bar and connected to be movable along the third slide guide.

The frame support module may further include a fourth slide guide supported by the frame base and extending in a left-right direction perpendicular to a running direction of the bicycle; and a fourth slide portion fixed to one end of the support bar and connected to be movable along the fourth slide guide.

The frame support module may further include an elastic member having one end supported by the frame base and the other end supported by the third slide portion, wherein the elastic member may be tensioned as the bicycle moves forward in the running direction of the bicycle.

The frame support module may further include a damper member having one end supported by the frame base and the other end supported by the third slide portion, wherein the damper member may decelerate a moving speed of the bicycle when the bicycle moves backward in the running direction of the bicycle by an elastic force of the elastic member.

A bicycle simulator according to an embodiment of the disclosure includes a base portion having a frame shape; a frame support portion module detachably supported by the base portion; and a third treadmill extending in a running direction of a bicycle, supporting a front wheel of the bicycle and a rear wheel of the bicycle, and rotating according to rotation of the front wheel and the rear wheel, wherein the frame support module includes a frame base having a frame and a side support portion disposed on a side surface of the frame; a support bar extending in one direction and supported by the frame base; and a support clamp disposed at one end of the support bar and supporting a bicycle frame connecting a front wheel of a mounted bicycle to a rear wheel of the mounted bicycle.

The third treadmill may include a plurality of third roller portions disposed to be apart from each other with a certain interval therebetween in the running direction of the bicycle; and a third belt disposed to surround outer circumferential surfaces of the plurality of third roller portions, wherein the frame support module may be disposed on the third belt.

The bicycle simulator may further include a plurality of third lifting portions disposed on each of the plurality of third roller portions, wherein the plurality of third lifting portions may be disposed at both ends of the third roller portion and move the third roller portion up and down in a vertical direction perpendicular to the running direction of the bicycle.

The bicycle simulator may further include a display device that visually provides a certain riding environment to a rider on the bicycle; and a controller that controls driving of the plurality of third lifting portions, wherein the controller may raise or lower each of the plurality of third roller portions to match a riding environment provided in real time through the display device.

Advantageous Effects of Disclosure

According to the disclosure, by disposing a treadmill supporting the front and rear wheels of a mounted bicycle, the same state as when the bicycle runs in a substantially flat state may be realized.

In addition, by changing a steering direction and relative position of the mounted bicycle according to the left and right steering, acceleration, and deceleration of the mounted bicycle, a dynamic experience extremely similar to an actual riding situation may be achieved.

In addition, because a bicycle support is detachably disposed on the treadmill, a bicycle simulator may be provided by using an existing treadmill.

MODE OF DISCLOSURE

Figure 1A:
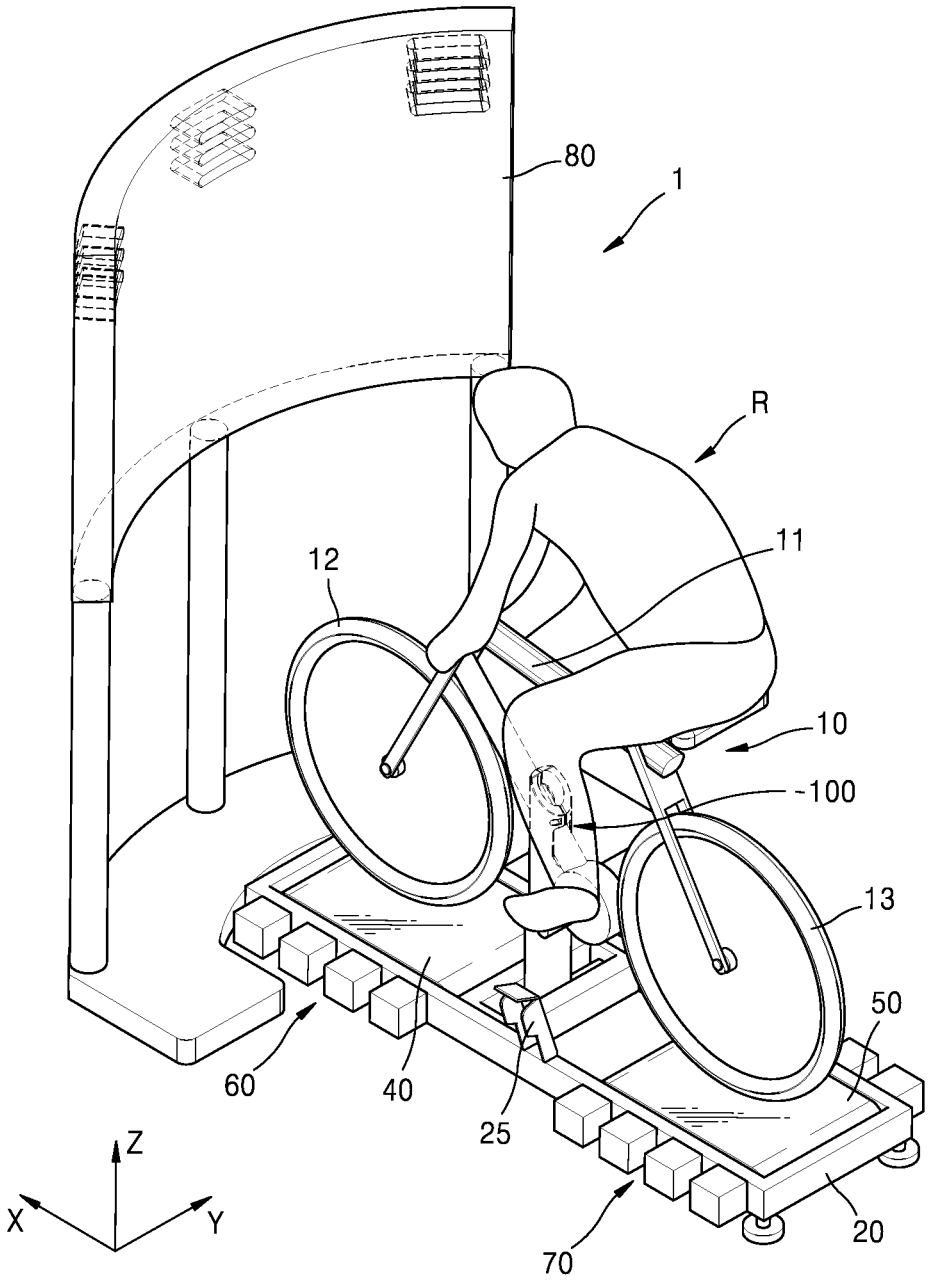
FIG. 1A is a perspective view of a bicycle simulator according to an embodiment of the disclosure.

The disclosure will now be described more fully with reference to the accompanying drawings, in which the following embodiments of the disclosure are shown. Like reference numerals in the drawings denote like elements, and thus their description will be omitted.

Because the embodiments may have various modifications, particular embodiments will be illustrated in the drawings and described in detail in the detailed description. Effects and characteristics of the disclosure, and methods of accomplishing them will be apparent by referring to embodiments described with reference to the drawings. The embodiments may, however, be embodied in many different forms and should not be construed as limited to the embodiments set forth herein.

While such terms as "first" and "second" may be used to describe various elements, such elements must not be limited to the above terms. The above terms are used to distinguish one element from another.

The singular forms "a," "an," and "the" as used herein are intended to include the plural forms as well unless the context clearly indicates otherwise.

In the following embodiments, the terms upper, lower, left and right (lateral), front (anterior), and rear (ventral or posterior), which indicate directions, are determined based on the relative positions between the drawings and the configurations for the convenience of explanation, not for the purpose of limitation of rights. Each direction described below is based thereon, unless otherwise specifically limited.

It will be understood that the terms "comprise", "comprising", "include", and/or "including" as used herein specify the presence of stated features or elements but do not preclude the addition of one or more other features or elements.

Sizes of components in the drawings may be exaggerated for convenience of explanation. In other words, because sizes and thicknesses of components in the drawings are arbitrarily illustrated for convenience of explanation, the following embodiments are not limited thereto.

Figure 1B:
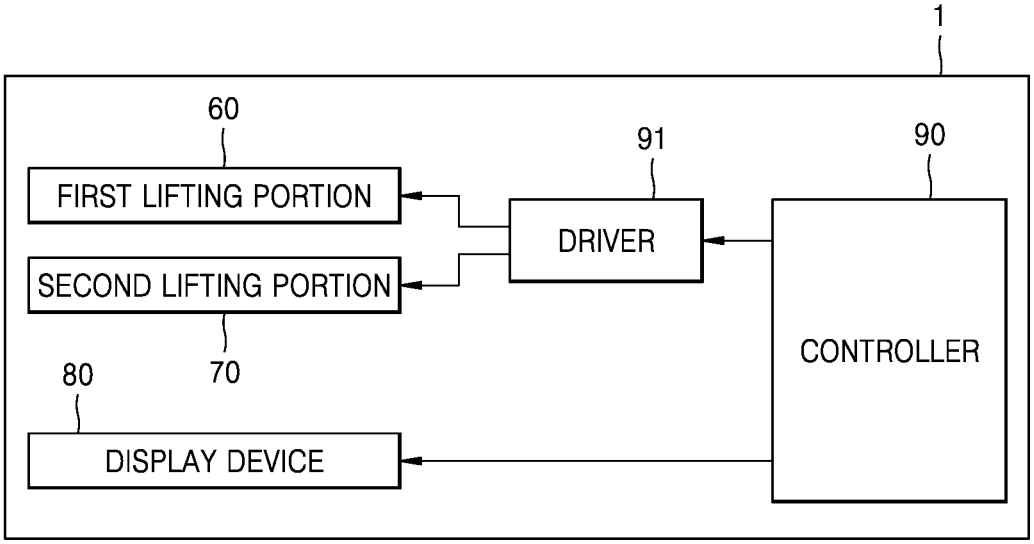
FIG. 1B is a schematic block diagram of a bicycle simulator according to an embodiment of the disclosure.
Figure 2A:
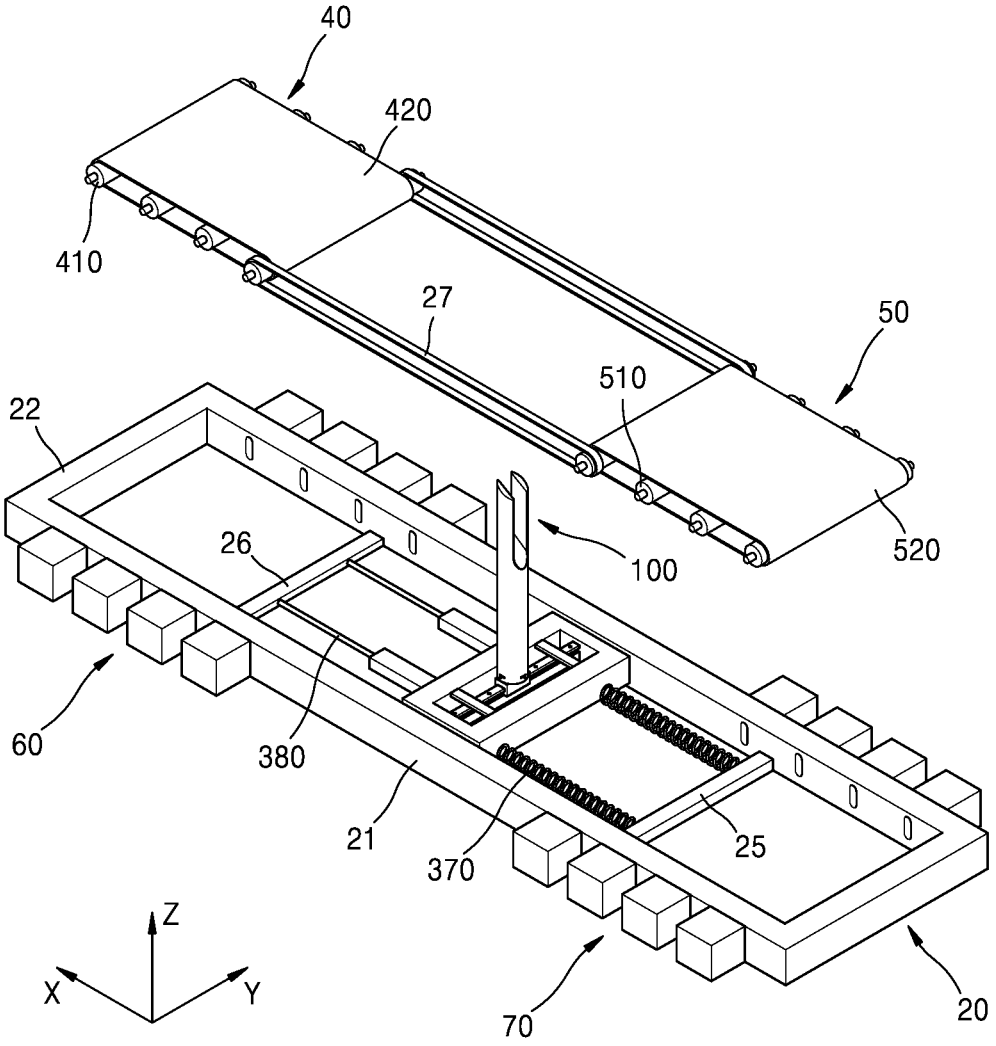
FIG. 2A is an exploded perspective view of a bicycle simulator according to an embodiment of the disclosure.
Figure 2B:
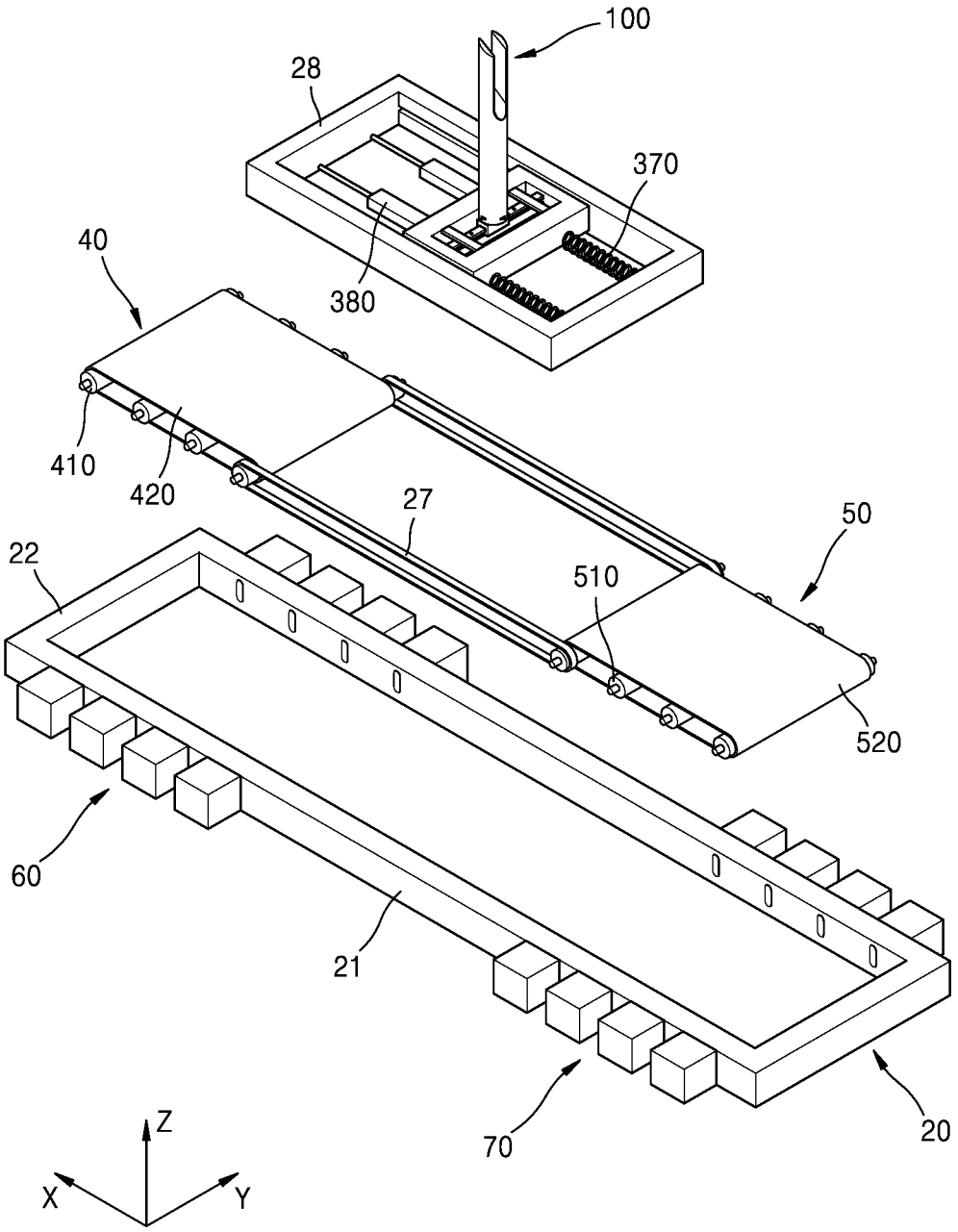
FIG. 2B is an exploded perspective view of a bicycle simulator according to another embodiment of the disclosure.
Figure 2C:
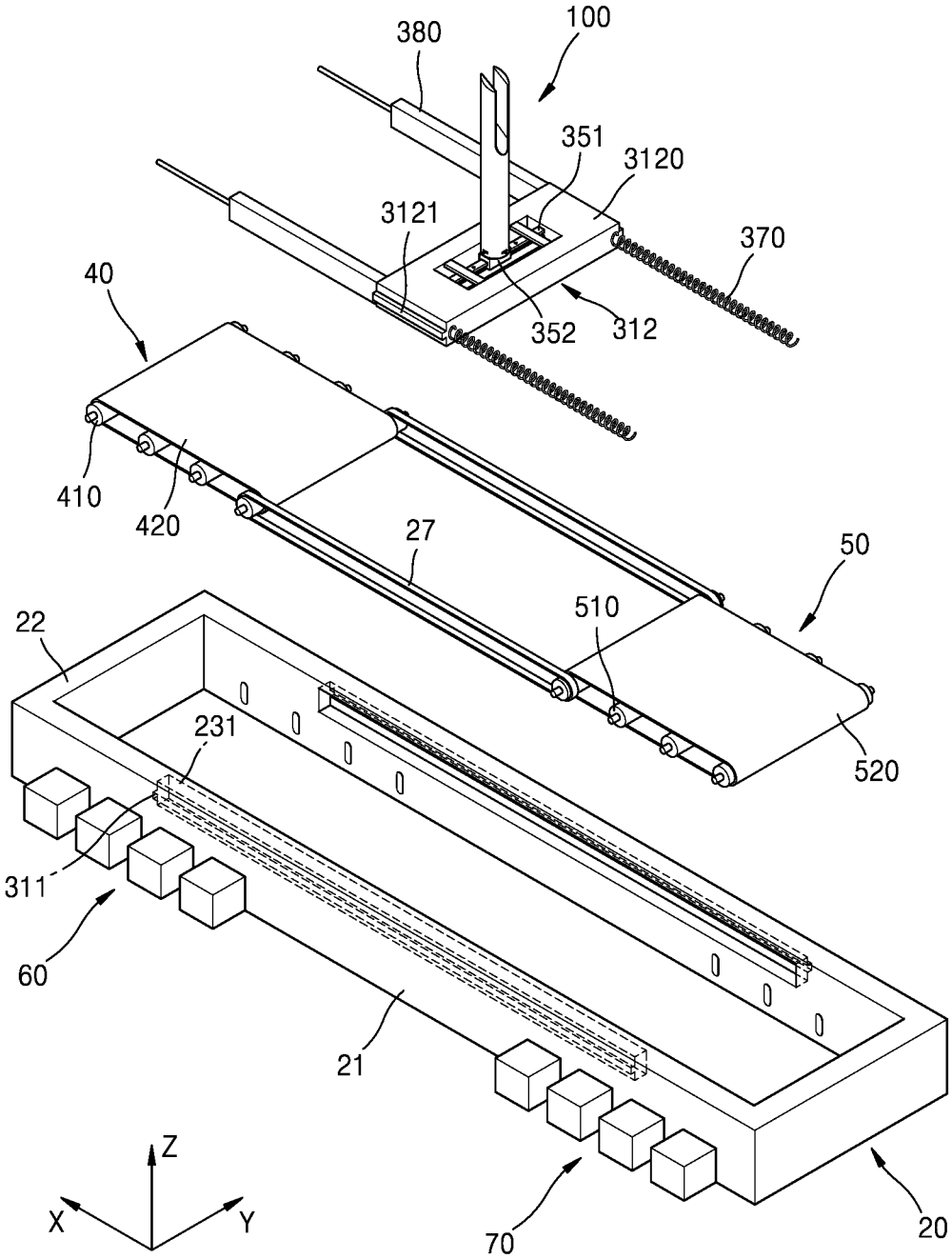
FIG. 2C is an exploded perspective view of a bicycle simulator according to another embodiment of the disclosure.
Figure 3A:
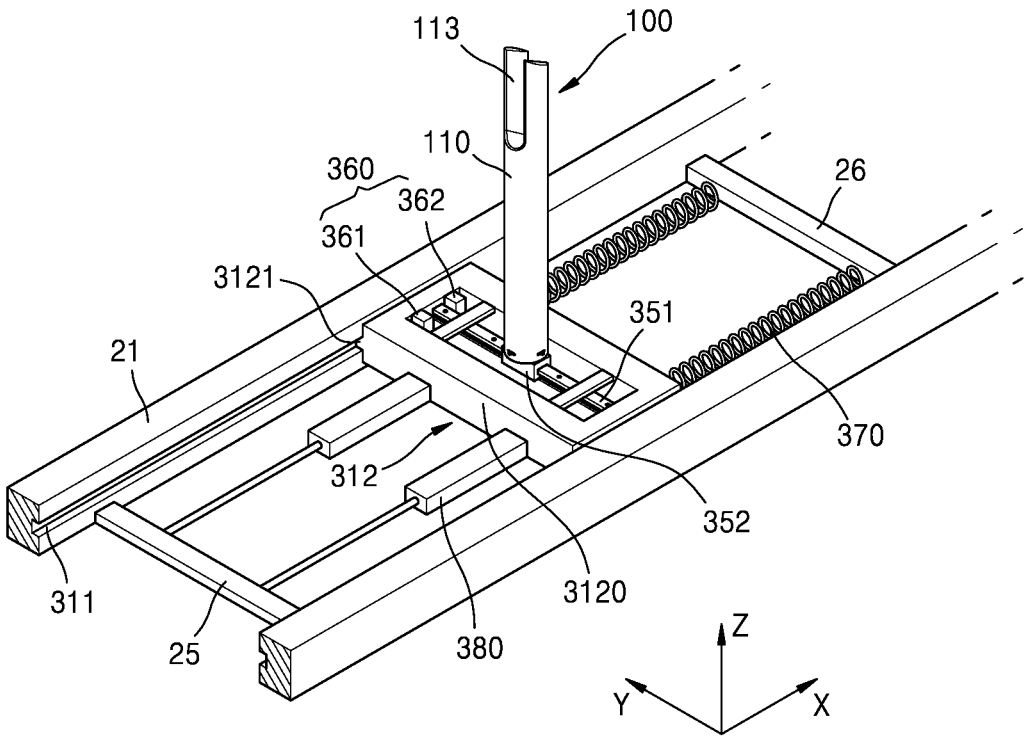
FIG. 3A is a perspective view of a frame support portion according to an embodiment of the disclosure.
Figure 3B:
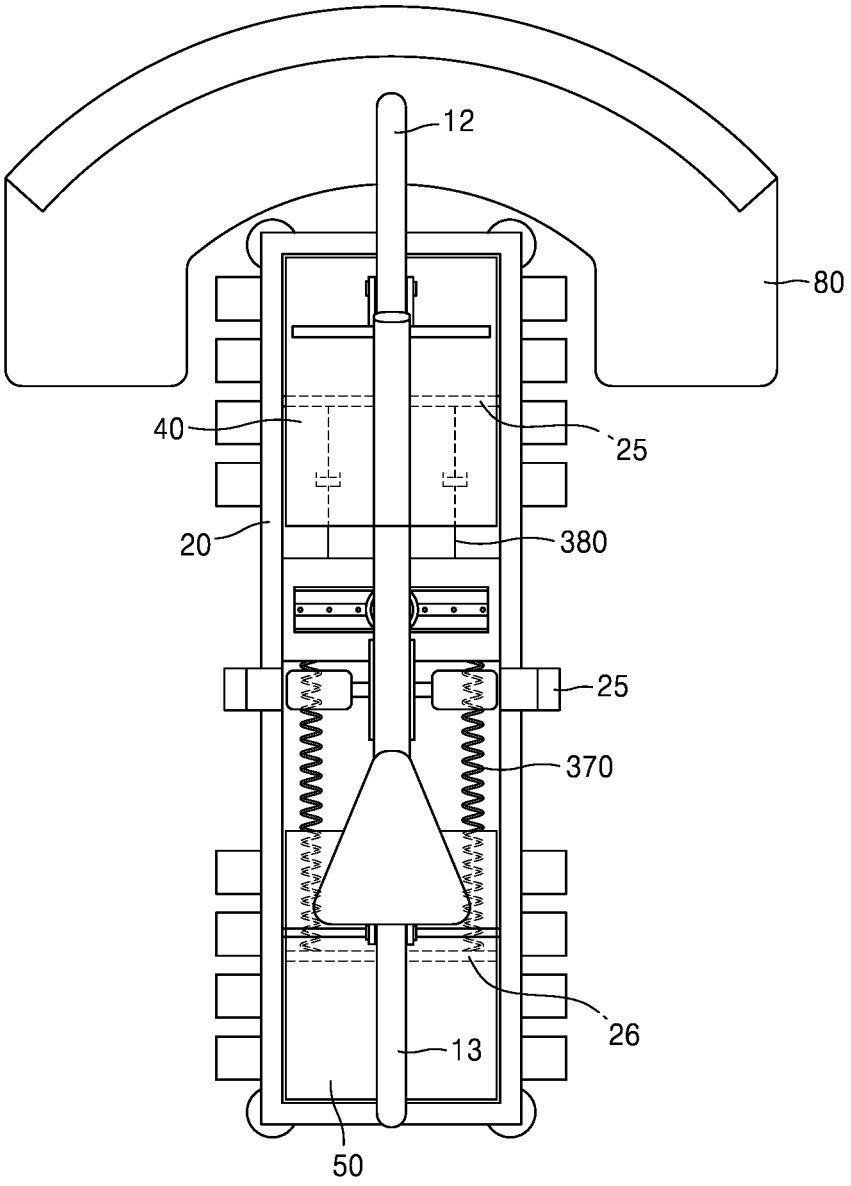
FIG. 3B is a plan view of a bicycle simulator according to an embodiment of the disclosure.
Figure 3C:
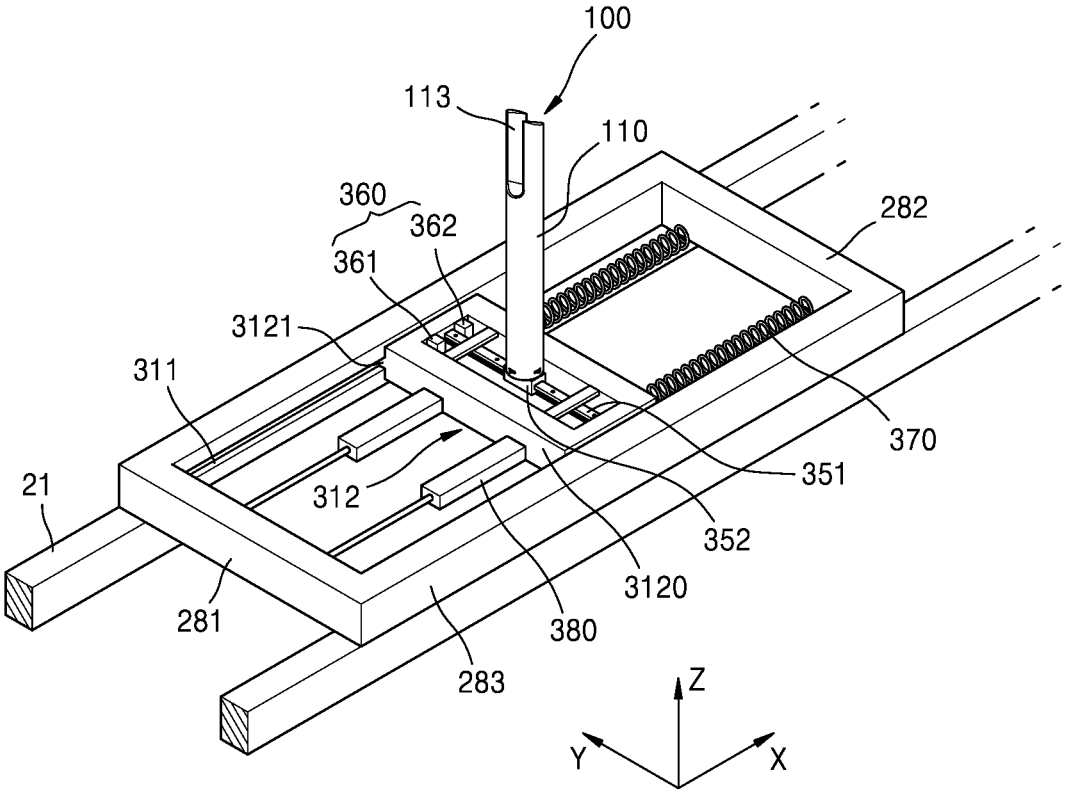
FIG. 3C is a perspective view of a frame support portion according to another embodiment of the disclosure.
Figure 3D:
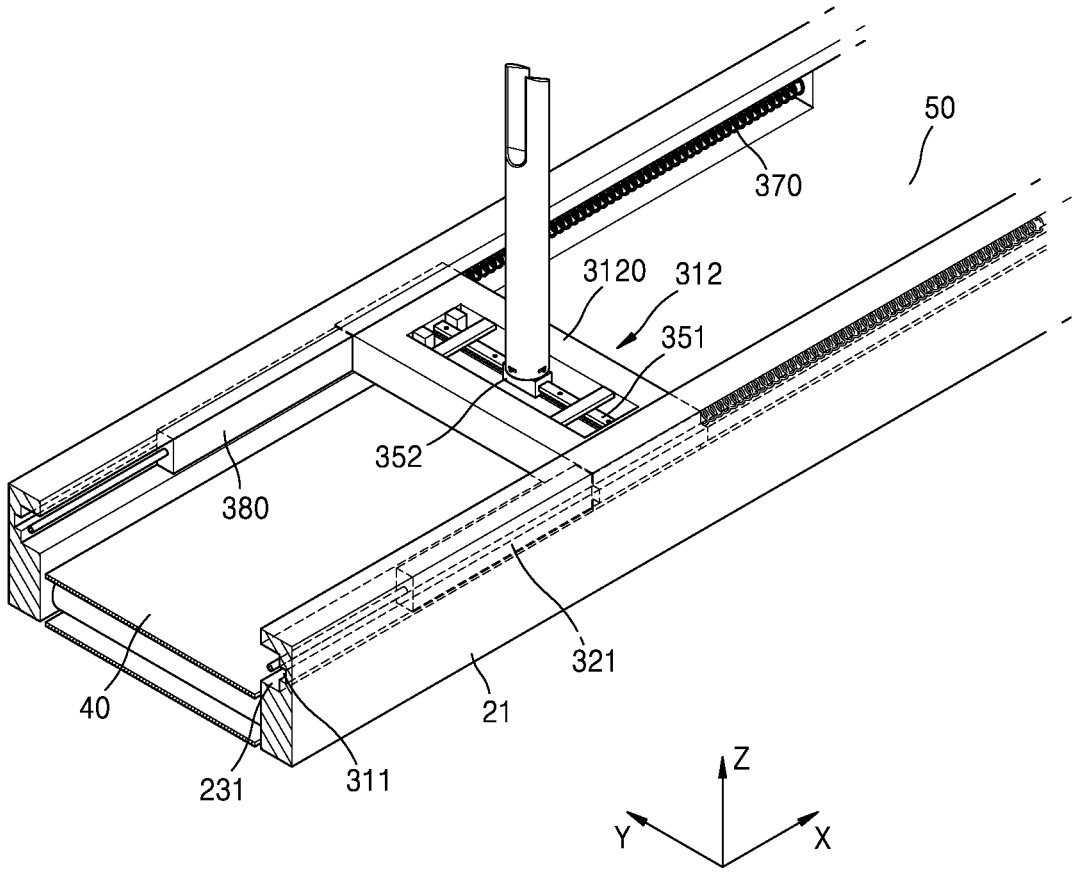
FIG. 3D is a perspective view of a frame support portion according to another embodiment of the disclosure.

FIG. 1A is a perspective view of a bicycle simulator according to an embodiment of the disclosure. FIG. 1B is a schematic block diagram of a bicycle simulator according to an embodiment of the disclosure. FIG. 2A is an exploded perspective view of a bicycle simulator according to an embodiment of the disclosure. FIG. 2B is an exploded perspective view of a bicycle simulator according to another embodiment of the disclosure. FIG. 2C is an exploded perspective view of a bicycle simulator according to another embodiment of the disclosure. FIG. 3A is a perspective view of a frame support portion according to an embodiment of the disclosure. FIG. 3B is a plan view of a bicycle simulator according to an embodiment of the disclosure. FIG. 3C is a perspective view of a frame support portion according to another embodiment of the disclosure. FIG. 3D is a perspective view of a frame support portion according to another embodiment of the disclosure.

In a bicycle simulator 1 according to an embodiment of the disclosure, a rider R on a bicycle 10 may virtually experience various conditions of a road surface having an inclined portion, thereby allowing the rider R to enjoy dynamic and realistic riding. In addition, by providing various driving modes in which a steering range may be adjusted according to the type of the rider R, maximization of an exercise effect according to the type of the rider R may be made naturally.

The bicycle 10 stated above may be not only specially produced for the bicycle simulator 1 according to an embodiment of the disclosure, but also may include all bicycles commercially available from various manufacturers. The bicycle 10 may include a bicycle frame 11 constituting a body of the bicycle 10, a front wheel 12 and a rear wheel 13 each rotatably mounted on the bicycle frame 11, and a drive system (a crank, a chain, a transmission, etc.) that converts the pedaling of the rider R into a rotational force of the rear wheel 13.

The bicycle simulator 1 according to an embodiment of the disclosure may include a base portion 20, a first treadmill 40, a second treadmill 50, and a frame support portion 100 in order to implement functions or actions as described above.

Hereinafter, each element described above will be described in detail.

Referring to FIGS. 1A to 2B, the base portion 20 according to an embodiment of the disclosure is a support member fixed to the ground to support the bicycle 10. As an example, the base portion 20 may be provided to have a frame shape on which the first treadmill 40 and the second treadmill 50 to be described below may be seated, for example, a rectangular frame shape extending in one direction. As an example, the base portion 20 may further include an elastic member support portion 25 and a damper support portion 26 each extending between side portions 21 extending in a running direction (i.e., an X-axis direction) of the bicycle 10. However, the disclosure is not limited thereto, and an arbitrary support member on which the first treadmill 40 and the second treadmill 50 may be seated may be provided.

A leg support portion 25 may be disposed on both sides of the base portion 20 to support the legs of the rider R. As an example, before the rider R starts to ride, when the rider R is stationary while getting on the bicycle 10, the rider R may have a hard time finding the center of gravity. In this case, the leg support portion 25 that may support the legs of the rider R may be disposed on both sides of the base portion 20 so that the rider R may find the center. For example, although the leg support portion 25 may be provided to have an inclined surface to support the legs of the rider R, the disclosure is not limited thereto.

The first treadmill 40 is a support member that supports the front wheel 12 of the bicycle 10 mounted on the bicycle simulator 1 and rotates according to the rotation of the front wheel 12. As an example, the first treadmill 40 may include a plurality of first roller portions 410 arranged to be apart from each other with a certain interval therebetween in the running direction (i.e., the X-axis direction) of the bicycle 10, a first belt 420 disposed to surround the outer circumferential surfaces of the plurality of first roller portions 410 and rotating in an endless track, and a plate-shaped deck (not shown) disposed between the plurality of first roller portions 410 and capable of supporting the load of the front wheel 12. Both ends of each of the first roller portions 410 may rotate by forming an axial coupling to the base portion 20, and may move in a direction (i.e., a Z-axis direction) perpendicular to the running direction (i.e., the X-axis direction) of the bicycle 10 with respect to the base portion 20. The vertical movement of the first roller portion 410 with respect to the base portion 20 is described below with reference to FIGS. 5A to 7C.

The second treadmill 50 is a support member that supports the rear wheel 13 of the bicycle 10 mounted on the bicycle simulator 1 and rotates according to the rotation of the rear wheel 13. As an example, the second treadmill 50 may include a plurality of second roller portions 510 arranged to be apart from each other with a certain interval therebetween in the running direction (i.e., the X-axis direction) of the bicycle 10, a second belt 520 disposed to surround the outer circumferential surfaces of the plurality of second roller portions 510 and rotating in an endless track, and a plate-shaped deck (not shown) disposed between the plurality of second roller portions 510 and capable of supporting the load of the rear wheel 13. Both ends of each of the second roller portions 510 may rotate by forming an axial coupling to the base portion 20, and may move in the direction (i.e., the Z-axis direction) perpendicular to the running direction (i.e., the X-axis direction) of the bicycle 10 with respect to the base portion 20. The vertical movement of the second roller portion 510 with respect to the base portion 20 is described below with reference to FIGS. 5A to 7C.

As the first treadmill 40 and the second treadmill 50 as described above include the first belt 420 supported by the plurality of first roller portions 410 and the second belt 520 supported by the plurality of second roller portions 510, respectively, a support point M (see FIG. 6) of the front wheel 12 and a support point N (see FIG. 6) of the rear wheel 13 may be disposed on the same plane. On the other hand, the front wheel and the rear wheel of a bicycle mounted in a conventional bicycle simulator may be supported using a front wheel roller and a rear wheel roller, and accordingly, a supporting point of the front wheel and a supporting point of the rear wheel may not be the same. Accordingly, an inclined portion having a certain angle may be formed between the supporting point of the front wheel and the supporting point of the rear wheel. Accordingly, the rider R using a bicycle simulator according to an embodiment of the disclosure may experience the same riding state as riding on a substantially flat ground and prevent loss of kinetic energy due to unnecessary frictional force.

A driving force transmission belt 27 may be disposed between the first roller portion 410 and the second roller portion 510 to transmit a driving force between the first treadmill 40 and the second treadmill 50. As an example, the driving force transmission belt 27 may be formed to extend in one direction, and may be disposed between both ends of a first roller portion 410 and a second roller portion 510 disposed most adjacently among the plurality of first roller portions 410 and the plurality of second roller portions 510, for example, between both ends of a first roller portion 410 disposed rearmost and a second roller portion 510 disposed frontmost, to transmit rotational force.

As an example, when the rider R rotates the rear wheel 13 of the bicycle 10, the second treadmill 50 may also rotate by a rotational force of the rear wheel 13. In this case, a rotational force of the second treadmill 50 may be transmitted to the first treadmill 40 through the driving force transmission belt 27. Accordingly, the rotation speed of the first treadmill 40 and the rotation speed of the second treadmill 50 may be equal to each other, and thus, a stable riding experience may be provided to the rider R.

Also, as an example, the driving force transmission belt 27 may be disposed on the outer side of the base portion 20, more specifically, the side portion 21, for the convenience of replacement and maintenance. In this case, the first roller portion 410 and the second roller portion 510 may rotate with respect to the base portion 20 without a separate rotation shaft by using a bearing portion (not shown) arranged along the outer circumferential surfaces of the first roller portion 410 and the second roller portion 510.

Referring to FIGS. 3A and 3B, the frame support portion 100 according to an embodiment is a support member for stably fixing the position of the bicycle 10 by supporting the bicycle frame 11. As an example, the frame support portion 100 may include a support bar 110 and a support clamp 113.

The support bar 110 is a support member in the shape of a straight rod extending in one direction. As an example, one end of the support bar 110 may be disposed to be fixed to a second slide portion 352, which is described below, and may move in a left-right direction (i.e., a Y-axis direction) together with the second slide portion 352. In addition, the support clamp 113 may be disposed at the other end of the support bar 110 to support the bicycle frame 11. As an example, the support clamp 113 may be formed to fix a part of the bicycle frame 11, for example, at least one of a down tube and a top tube of the bicycle frame 11, and thus, the bicycle 10 may be supported by the bicycle simulator 1.

The frame support portion 100 according to an embodiment may move in the running direction (i.e., the X-axis direction) of the bicycle 10 or the left-right direction (i.e., the Y-axis direction) with respect to the base portion 20, and accordingly, the bicycle 10 supported by the frame support portion 100 may also move in the running direction (i.e., the X-axis direction) of the bicycle 10 or the left-right direction (i.e., the Y-axis direction) with respect to the base portion 20. Accordingly, when the bicycle 10 supported by the frame support portion 100 moves in the running direction (i.e., the X-axis direction) of the bicycle 10 with respect to the base portion 20, the rider R may experience acceleration and deceleration driving conditions. In addition, when the bicycle 10 supported by the frame support portion 100 moves in the left-right direction (i.e., the Y-axis direction) with respect to the base portion 20, the rider R may experience a rotational driving state according to the steering of the bicycle 10.

The bicycle simulator 1 according to an example may further include a first slide guide 311 disposed on both sides of the base portion 20 and extending in the running direction (i.e., the X-axis direction) of the bicycle 10, and a first slide portion 312 supported by the frame support portion 100 and connected to be slidable along the first slide guide 311.

As an example, the first slide guide 311 may be disposed on inner surfaces of both side portions 21 of the base portion 20. In this case, the first slide guide 311 may extend in the running direction (i.e., the X-axis direction) of the bicycle 10.

The first slide portion 312 is a slide member inserted into the first slide guide 311 to move in the running direction (i.e., the X-axis direction) of the bicycle 10. As an example, the frame support portion 100 may be supported by the first slide portion 312, and accordingly, the frame support portion 100 may move in the running direction (i.e., the X-axis direction) of the bicycle 10 together with the first slide portion 312.

For example, the first slide portion 312 may include a frame 3120 having a rectangular shape and a protrusion 3121 that is disposed on both sides of the frame 3120 and may be inserted into the first slide portion 312. In this case, the frame support portion 100 may be supported by the first slide portion 312 by using a second slide guide 351 that is described below.

The bicycle simulator 1 according to an example may further include the second slide guide 351 supported by the base portion 20 for movement in the left-right direction (i.e., the Y-axis direction) of the frame support portion 100 and extending in the left-right direction (i.e., the Y-axis direction) of the bicycle 10, and a second slide portion 352 fixed to the frame support portion 100 and connected to be slidable along the second slide guide 351.

As an example, the second slide guide 351 may be disposed to be fixed inside the frame 3120 included in the first slide portion 312. In this case, the second slide guide 351 may extend in the left-right direction (i.e., the Y-direction).

The second slide portion 352 is a slide member inserted into the second slide guide 351 to move in the left-right direction (i.e., the Y-direction). As an example, the second slide portion 352 may be fixed to one end of the frame support portion 100, and accordingly, the frame support portion 100 may move in the left-right direction (i.e., the Y-direction) together with the second slide portion 352.

A movement interval detector 360 may detect and track a movement interval generated as the second slide portion 352 moves along the second slide guide 351. As an example, the movement interval detector 360 may be a Time-of-Flight (ToF) camera, which is a type of depth camera. For example, when the movement interval detector 360 is implemented as a ToF camera, the movement interval detector 360 may include a light source 361 irradiating certain light, and a sensor portion 362 that detects reflected light returned when the light irradiated from the light source 361 is reflected by a part of the second slide portion 352. In the embodiment described above, a ToF camera is disclosed as an example of the movement interval detector 360, but the disclosure is not limited thereto. The movement interval detector 360 according to an example may be implemented as an arbitrary sensing device capable of detecting and tracking the movement interval of the second slide portion 352 with respect to the base portion 20.

According to an example, the movement interval detector 360 may detect a left-right movement range and a left-right movement direction of the second slide portion 352, more specifically, the frame support portion 100, with respect to the base portion 20. A steering direction of the movement interval detector 360 may be detected according to a movement direction of the second slide portion 352 detected by the movement interval detector 360, and a steering degree may be detected according to a movement range of the second slide portion 352 detected by the movement interval detector 360.

Referring to FIGS. 2B and 3C, the bicycle simulator 1 according to another embodiment may further include a base frame 28 disposed to be fixed to both side portions 21 of the base portion 20. According to an example, the first slide guide 311 may be disposed in the base frame 28. For example, the first slide guide 311 may be disposed on inner surfaces of both side portions 283 of the base frame 28. In this case, the first slide guide 311 may extend in the running direction (i.e., the X-axis direction) of the bicycle 10. In this case, the bicycle simulator 1 may further include a first slide portion 312 supported by the frame support portion 100 and connected to be slidable along the first slide guide 311.

The first slide portion 312 is a slide member inserted into the first slide guide 311 to move in the running direction (i.e., the X-axis direction) of the bicycle 10. As an example, the frame support portion 100 may be supported by the first slide portion 312, and accordingly, the frame support portion 100 may move in the running direction (i.e., the X-axis direction) of the bicycle 10 together with the first slide portion 312.

For example, the first slide portion 312 may include a frame 3120 having a rectangular shape and a protrusion 3121 that is disposed on both sides of the frame 3120 and may be inserted into the first slide portion 312. In this case, the frame support portion 100 may be supported by the first slide portion 312 by using a second slide guide 351 that is described below. Detailed descriptions of the second slide guide 351, the second slide portion 352, and the movement interval detector 360 are substantially the same as those of the configurations shown in FIGS. 2A and 3A, and thus, descriptions thereof will be omitted. By disposing the separate base frame 28 on an upper part of the base portion 20 as described above, the first slide guide 311 may extend in the running direction (i.e., the X-axis direction) of the bicycle 10 without interfering with the first treadmill 40 and the second treadmill 50. Accordingly, the first slide portion 312 moving along the first slide guide 311 may move in the running direction (i.e., the X-axis direction) of the bicycle 10 in a wider driving range without interfering with the first treadmill 40 and the second treadmill 50.

Referring to FIGS. 2C and 3D, in the bicycle simulator 1 according to another embodiment, a first slide guide 311 may be disposed on both side portions 21 of the base portion 20. For example, the first slide guide 311 may be disposed on inner surfaces of both side portions 21 of the base frame 20. In this case, the first slide guide 311 may extend in the running direction (i.e., the X-axis direction) of the bicycle 10. In this case, the bicycle simulator 1 may further include a first slide portion 312 supported by the frame support portion 100 and connected to the first slide guide 311 to be slidable along the first slide guide 311.

The first slide portion 312 is a slide member inserted into the first slide guide 311 to move in the running direction (i.e., the X-axis direction) of the bicycle 10. As an example, the frame support portion 100 may be supported by the first slide portion 312, and accordingly, the frame support portion 100 may move in the running direction (i.e., the X-axis direction) of the bicycle 10 together with the first slide portion 312.

For example, the first slide portion 312 may include a frame 3120 having a rectangular shape and a protrusion 3121 that is disposed on both sides of the frame 3120 and may be inserted into the first slide portion 312. In this case, the frame support portion 100 may be supported by the first slide portion 312 by using a second slide guide 351 that is described below. Detailed descriptions of the second slide guide 351, the second slide portion 352, and the movement interval detector 360 are substantially the same as those of the configurations shown in FIGS. 2A and 3A, and thus, descriptions thereof will be omitted. As described above, as the first slide guide 311 is disposed on the inner surfaces of both side portions 21 of the base portion 20, the first slide guide 311 may extend in the running direction (i.e., the X-axis direction) of the bicycle 10 without interfering with the first treadmill 40 and the second treadmill 50. Accordingly, the first slide portion 312 moving along the first slide guide 311 may move in the running direction (i.e., the X-axis direction) of the bicycle 10 in a wider driving range without interfering with the first treadmill 40 and the second treadmill 50.

Referring back to FIGS. 1A to 2B, a display device 80 is a component that visually transmits a riding environment or operating system program for the course of a bicycle competition to the rider R. As shown in FIG. 1A, the display device 80 may be a curved display device sized to cover all the front viewing angles of the rider R or a goggle-type display device (not shown) worn by the rider R. As an example, when the display device 80 realistically displays a certain riding environment, the rider R may variously adjust the inclination angle of the bicycle 10 based on road surface condition information corresponding to a riding environment provided in real time.

A controller 90 may be hardware that controls all functions and operations of the bicycle simulator 1. The controller 90 may be implemented in the form of one microprocessor module, or may be implemented in a form in which two or more microprocessor modules are combined. That is, the implementation form of the controller 90 is not limited by any form.

Figure 4A:
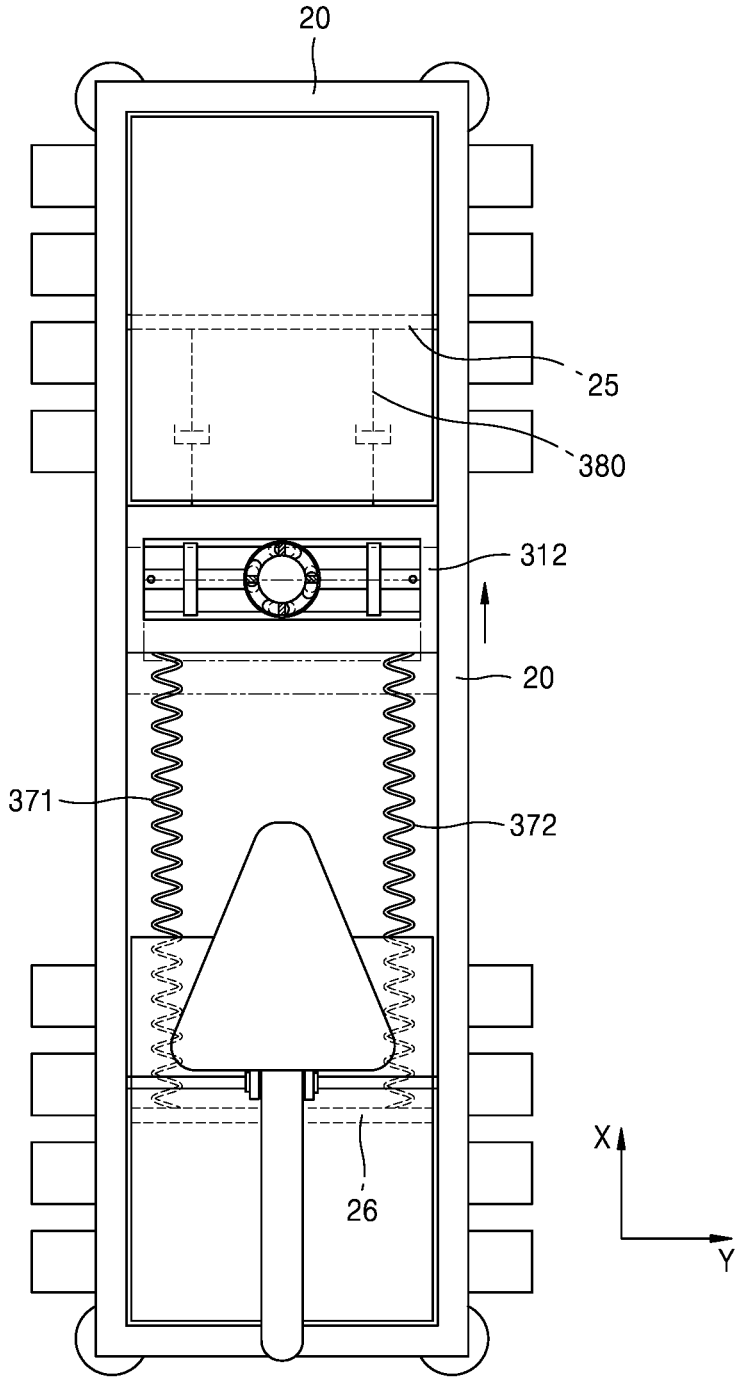
FIGS. 4A and 4B are plan views of a bicycle simulator according to an embodiment of the disclosure.
Figure 4B:
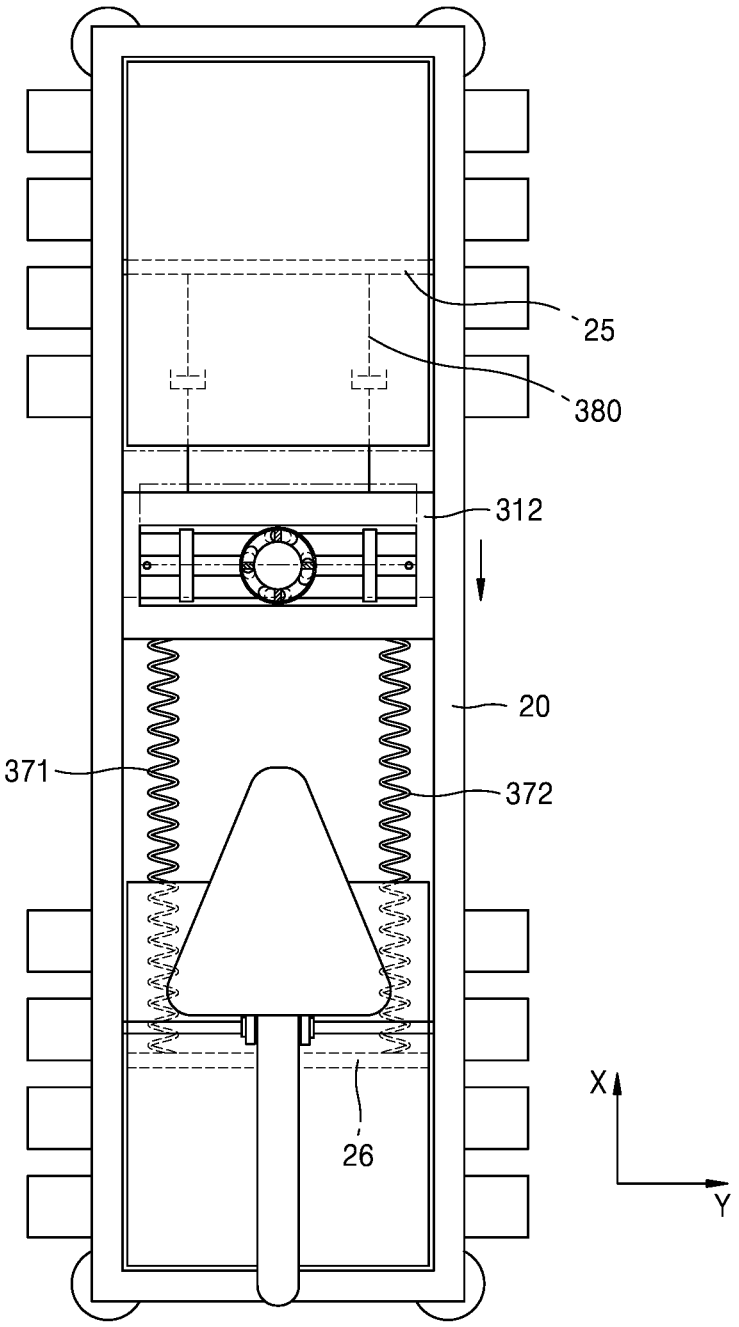

FIGS. 4A and 4B are plan views of a bicycle simulator according to an embodiment of the disclosure.

As described above, the bicycle 10 supported by the frame support portion 100 may move in the running direction (i.e., the X-axis direction) of the bicycle 10 by using the first slide portion 312. As an example, when the first treadmill 40 and the second treadmill 50 respectively supporting the front wheel 12 and the rear wheel 13 of the bicycle operate in a non-motorized manner without including a separate driving portion, the first slide portion 312 supported by the bicycle 10 may move in the running direction (i.e., the X-axis direction) of the bicycle 10 as the speed of the bicycle 10 is accelerated or decelerated. As an example, when a sudden change in the speed of the bicycle 10 occurs, a risk may be posed to the safety of the rider R, and thus, a buffer member capable of preventing the sudden movement of the first slide portion 312 may be required.

Referring to FIGS. 3A, 4A and 4B, the bicycle simulator 1 according to an example may further include an elastic member 370 having one end supported by the elastic member support portion 25 extending between the side portions 21 of the base portion 20 and the other end supported by the first slide portion 312, and a damper member 380 having one end supported by the damper support portion 26 extending between the side portions 21 of the base portion 20 and the other end supported by the first slide portion 312.

As an example, the elastic member 370 may apply an elastic force to the first slide portion 312 in the running direction (i.e., the X-axis direction) of the bicycle 10. For example, one or more elastic members 370 may be provided. For example, the elastic member 370 may include a first elastic member 371 and a second elastic member 372, which are disposed to be symmetrical in the left-right direction (i.e., the Y-axis direction). According to an example, as shown in FIG. 4A, when the first slide portion 312 advances by the acceleration of the bicycle 10, the elastic member 370 may be tensioned. In addition, as shown in FIG. 4B, when the bicycle 10 is decelerated, the tensioned elastic member 370 may apply an elastic force to the first slide portion 312, and accordingly, the first slide portion 312 may automatically return to an original position in the running direction (i.e., the X-axis direction) of the bicycle 10. Accordingly, when two or more riders R use the bicycle simulator 1 at the same time, the positions of the two or more riders R may be differently arranged in the running direction (i.e., the X-axis direction) of the bicycle 10 according to the acceleration and deceleration of the bicycle 10. Accordingly, a riding experience similar to that of leading and trailing outdoor riding may be experienced.

As an example, the damper member 380 is a shock absorber for preventing the first slide portion 312 from rapidly moving according to the rapid acceleration and deceleration of the bicycle 10. For example, as shown in FIG. 4A, when the first slide portion 312 is advanced by the acceleration of the bicycle 10, the damper member 380 may apply a buffering force in a direction opposite to the moving direction of the first slide portion 312. In addition, as shown in FIG. 4B, when an elastic force is applied by the elastic member 370 to move the first slide portion 312 backward, the damper member 380 may apply a buffering force in a direction opposite to the moving direction of the first slide portion 312. Accordingly, the rider R may more safely move in the running direction (i.e., the X-axis direction) of the bicycle 10 regardless of the rapid acceleration and deceleration of the bicycle 10. Referring to FIGS. 2B and 3C, the bicycle simulator 1 according to another example may further include an elastic member 370 having one end supported by a rear end 282 extending between the side portions 283 of the base frame 28 and the other end supported by the first slide portion 312, and a damper member 380 having one end supported by a front end 281 extending between the side portions 283 of the base frame 28 and the other end supported by the first slide portion 312. Detailed descriptions of the elastic member 370 and the damper member 380 are substantially the same as those of the configurations shown in FIGS. 2A and 3A, and thus, descriptions thereof will be omitted.

Referring to FIGS. 2C and 3D, the bicycle simulator 1 according to another example may further include an elastic member 370 and a damper member 380, which are inserted into a receiving groove 231 formed in the inner surfaces of both side portions 21 of the base portion 20. One end of the elastic member 370 according to an example may be supported by one end of the receiving groove 231, and the other end of the elastic member 370 may be supported by the first slide portion 312. In addition, one end of the damper member 380 may be supported by the other end of the receiving groove 231, and the other end of the damper member 380 may be supported by the first slide portion 312. Detailed descriptions of the elastic member 370 and the damper member 380 are substantially the same as those of the configurations shown in FIGS. 2A and 3A, and thus, descriptions thereof will be omitted.

The receiving groove 231 according to an example may be located above the first treadmill 40 and the second treadmill 50 in the Z-axis direction. Accordingly, the elastic member 370 and the damper member 380 accommodated in the receiving groove 231 may not interfere with the first treadmill 40 and the second treadmill 50. Accordingly, the first slide portion 312 may not interfere with the first treadmill 40 and the second treadmill 50, and may move in the running direction (i.e., the X-axis direction) of the bicycle 10 in a wider driving range.

Figure 5A:
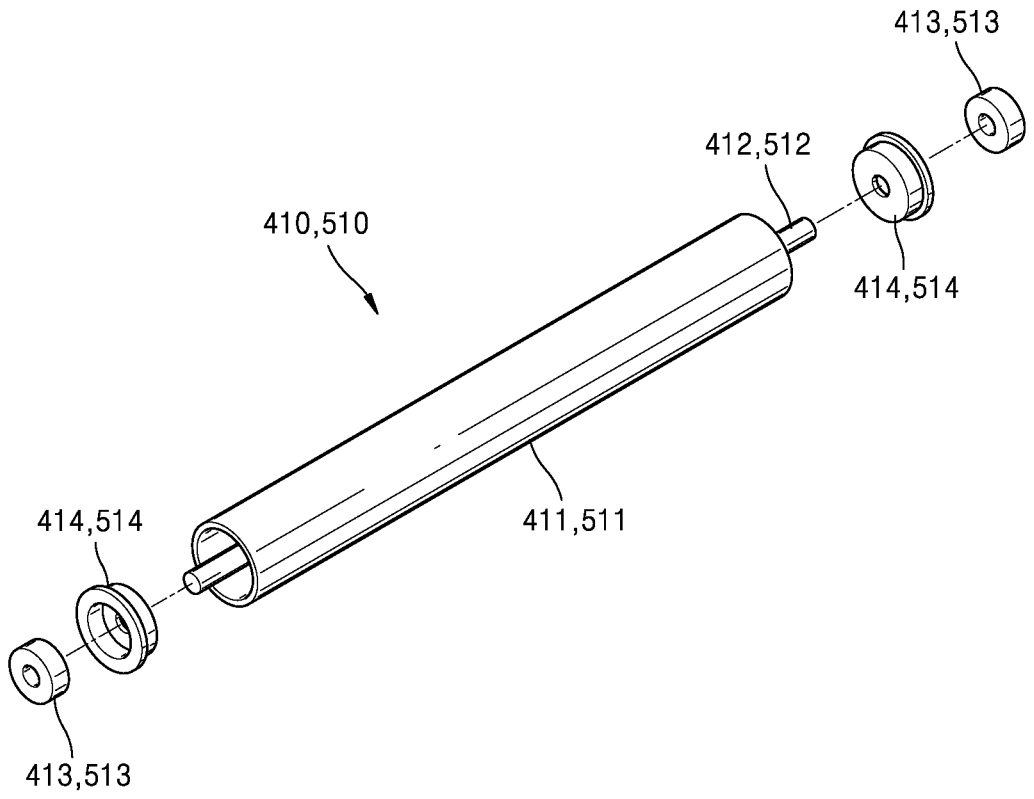
FIG. 5A is an exploded perspective view of a first roller portion according to an embodiment of the disclosure.
Figure 5B:
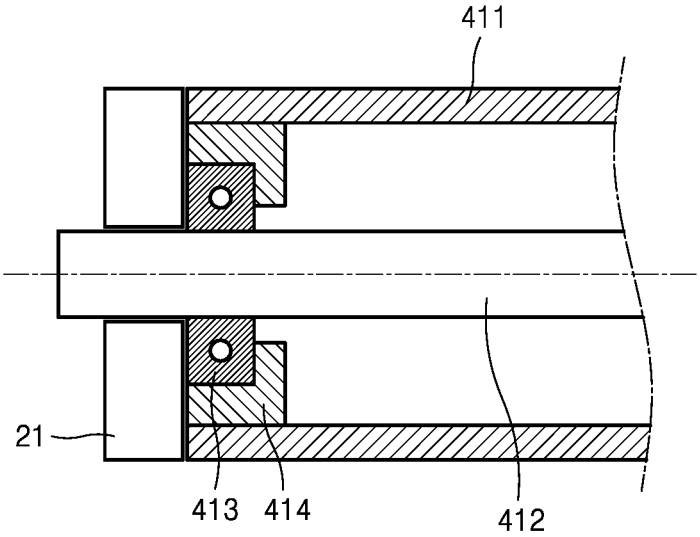
FIG. 5B is a cross-sectional view of a first roller portion according to an embodiment of the disclosure.
Figure 6:
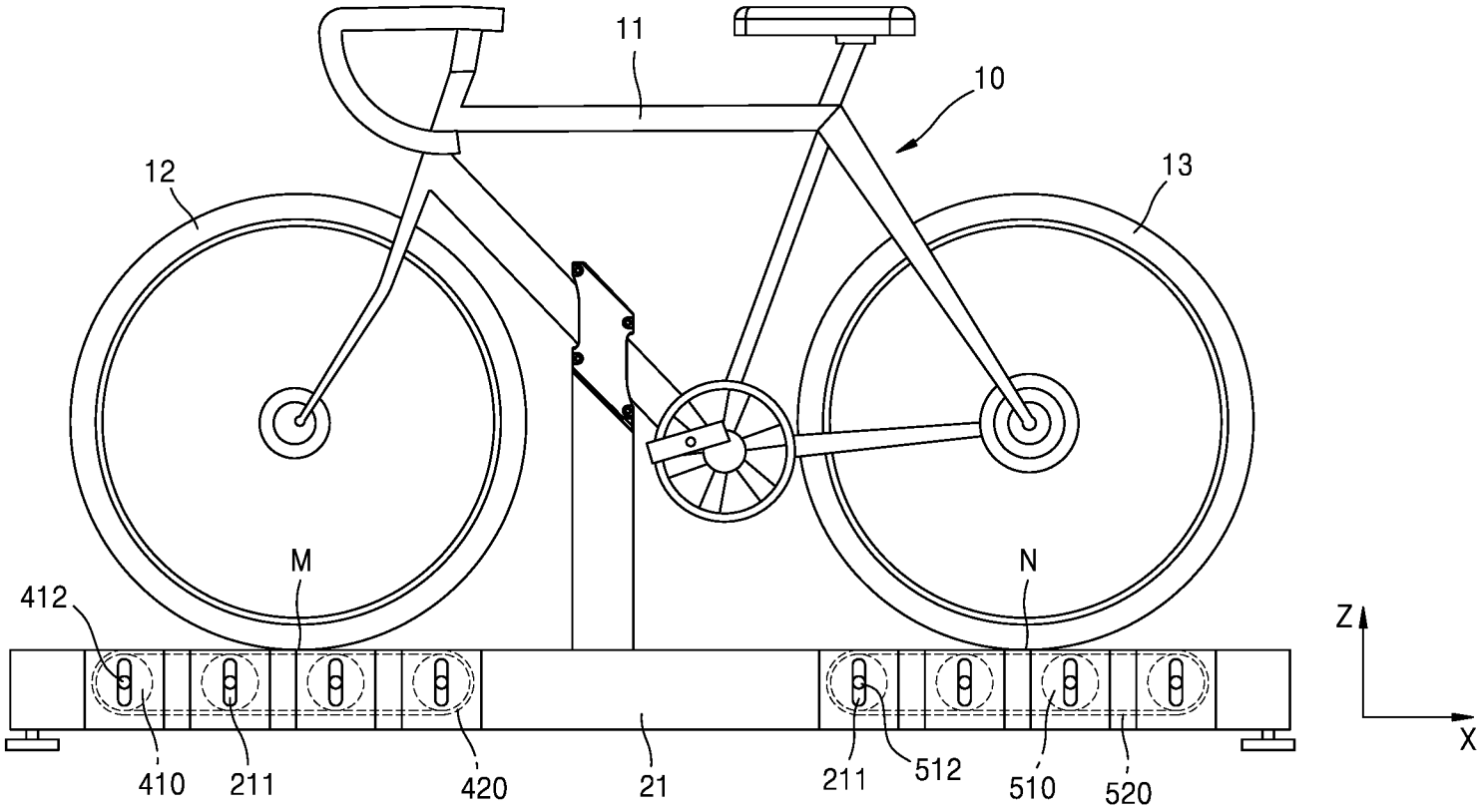
FIG. 6 is a side view of a bicycle simulator according to an embodiment of the disclosure.

FIG. 5A is an exploded perspective view of a first roller portion according to an embodiment. FIG. 5B is a cross-sectional view of a first roller portion according to an embodiment. FIG. 6 is a side view of a bicycle simulator according to an embodiment.

Referring to FIGS. 5A to 6, a first roller portion 410 according to an embodiment may include a tube 411 having a cylindrical structure, a support shaft 412 extending through the tube 411, a support cap 413 for supporting the support shaft 412, and a bearing 414 for supporting the tube 411.

As an example, the tube 411 may rotate about the support shaft 412 by using the bearing 414. In addition, both ends of the support shaft 412 may be disposed to protrude from the support cap 413. In this case, a plurality of insertion holes 211 extending in a vertical direction (i.e., the Z-axis direction) that is an up-down direction may be disposed in both side portions 21 of the base portion 20. As an example, both ends of the support shaft 412 may be disposed to be inserted into the insertion hole 211 provided in the side portions 21 of the base portion 20. In this case, the insertion hole 211 may serve as a guide when the support shaft 412 moves in the vertical direction (i.e., the Z-axis direction). Accordingly, the support shaft 412 may move in the vertical direction (i.e., the Z-axis direction) in an extension direction of the insertion hole 211, and the tube 411 supported by the support shaft 412 may also move in the vertical direction (i.e., the Z-axis direction), and accordingly, the first roller portion 410 may move in the vertical direction (i.e., the Z-axis direction) with respect to the base portion 20.

A second roller portion 510 according to an embodiment may also include a tube 511 having a cylindrical structure, a support shaft 512 extending through the tube 511, a support cap 513 for supporting the support shaft 512, and a bearing 514 for rotatably supporting the tube 511. The support shaft 512 included in the second roller portion 510 may be disposed in the insertion hole 211 and move in the vertical direction (i.e., the Z-axis direction), and accordingly, the second roller portion 510 may also move in the vertical direction (i.e., the Z-axis direction) with respect to the base portion 20. The technical features related thereto are substantially the same as the vertical movement of the first roller portion 410 and thus are omitted here for convenience of description.

As described above, each of the plurality of first roller portions 410 and each of the plurality of second roller portions 510 may move in the vertical direction (i.e., the Z-axis direction) with respect to the base portion 20. As each of the plurality of first roller portions 410 and each of the plurality of second roller portions 510 move in the vertical direction (i.e., the Z-axis direction) with respect to the base portion 20, the rider R on the bicycle 10 may experience the same riding condition as riding on a riding path having irregularities such as a mountain road, a downhill riding path, or an uphill riding path.

Figure 7A:
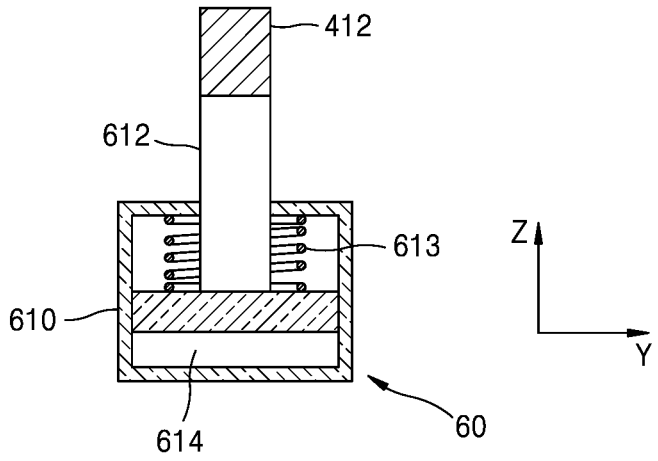
FIG. 7A is a schematic diagram of a first lifting portion according to an embodiment of the disclosure.
Figure 7B:
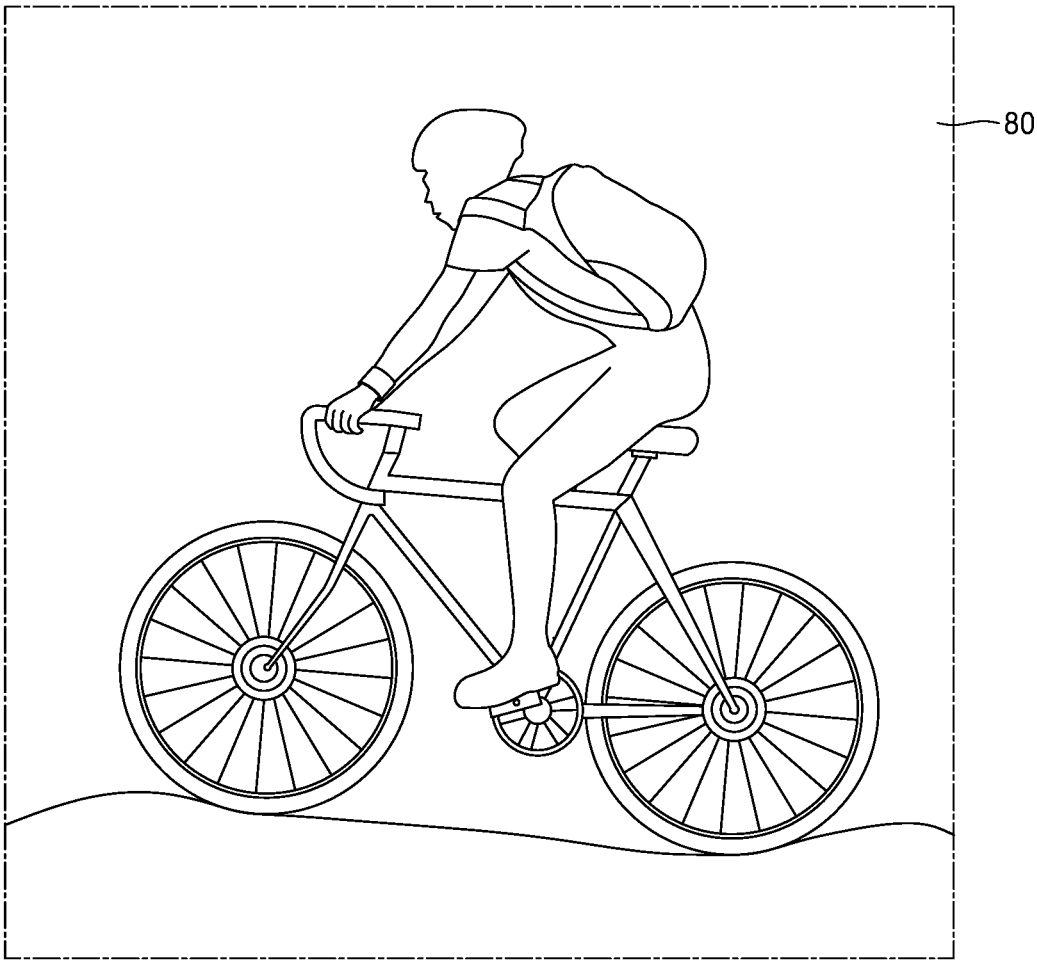
FIG. 7B is a schematic diagram of a display device on which a driving scene having an inclined portion is displayed, according to an embodiment of the disclosure.
Figure 7C:
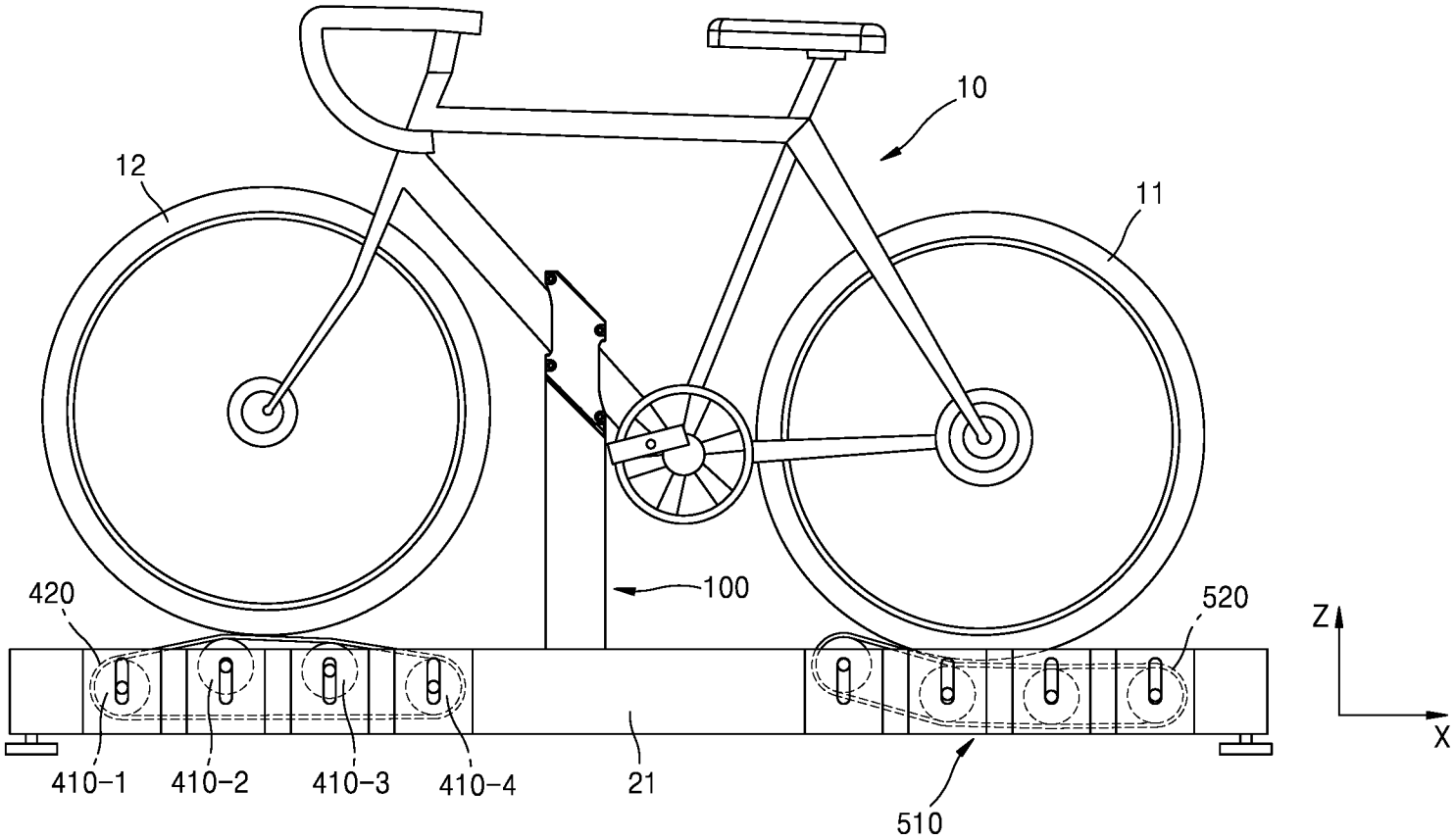
FIG. 7C is a side view of a bicycle simulator according to an embodiment of the disclosure.

FIG. 7A is a schematic diagram of a first lifting portion according to an embodiment. FIG. 7B is a schematic diagram of a display device on which a driving scene having an inclined portion is displayed, according to an embodiment of the disclosure. FIG. 7C is a side view of a bicycle simulator according to an embodiment.

Referring to FIGS. 1B and 7A, a first lifting portion 60 may include a hydraulic cylinder 610 having a hollow shape, a piston 612, an elastic body 613, and a fluid 614. The hydraulic cylinder 610 may be connected to be in fluid communication with a driver 91 controlled by the controller 90, for example, a hydraulic pump, and thus, the pressure of the fluid 614 transmitted from the hydraulic pump may be transmitted to one end of the piston 612. The hydraulic cylinder 610 may guide the reciprocating motion of the piston 612 while maintaining a closed state with the other end of the piston 612. In this case, one end of the support shaft 412 included in the first roller portion 410 may be connected to one end of the piston 612 to be fixed thereto. Accordingly, as the piston 612 moves in the vertical direction (i.e., the Z-axis direction), the support shaft 412 may also move in the vertical direction (i.e., the Z-axis direction). Also, in this case, between the hydraulic cylinder 610 and the piston 612, at least one elastic body 613 for elastically supporting the piston 612 inward with respect to the hydraulic cylinder 610 may be provided. The elastic body 613 may return the piston 612 to its original position downward when the operation of the driver 91 is stopped so as not to provide the fluid 614 into the hydraulic cylinder 610.

As described above, by using the driver 91 controlled by the controller 90, the piston 612 provided in the first lifting portion 60 may rise or fall in the vertical direction (i.e., the Z-axis direction), and the support shaft 412 connected to be fixed to the piston 612 may also rise or fall in the vertical direction (i.e., the Z-axis direction). That the support shaft 512 provided in the second roller portion 510 is raised or lowered in the vertical direction (i.e., the Z-axis direction) by the second lifting portion 70 is the same as that the support shaft 412 provided in the first roller portion 410 is raised or lowered in the vertical direction (i.e., the Z-axis direction) by the first lifting portion 60, and thus, descriptions thereof will be omitted.

Referring to FIGS. 1B and 7B, the display device 80 may display the appearance of the rider R riding uphill and downhill paths. As an example, such a riding path may be implemented as a mountain riding path. In this case, after the controller 90 recognizes a riding road state implemented in the display device 80, the controller 90 may operate the driver 91 to respond to a riding situation. As an example, the piston 612 provided in the first lifting portion 60 may rise in the Z-axis direction by the operation of the driver 91. Accordingly, as shown in FIG. 7C, the support shaft 412 supported by the piston 612 may also rise in the vertical direction (i.e., the Z-axis direction), and thus, one or more of a plurality of first roller portions 410, for example, a first-second roller portion 410-2 and a first-third roller portion 410-3, may rise in the vertical direction (i.e., the Z-axis direction). In this case, the rider R may move forward in the running direction (i.e., the X-axis direction) of the bicycle 10 by riding at an increased speed. Accordingly, the bicycle 10 in which the front wheel 12 is supported by the first-second roller portion 410-2 and the first-third roller portion 410-3 may also rise in the vertical direction (i.e., the Z-axis direction), and thus, the rider R may enjoy indoors a dynamic experience such as actually riding uphill.

Raising and lowering each of the plurality of second roller portions 510 in the vertical direction (i.e., the Z-axis direction) by using the second lifting portion 70 is substantially the same as raising and lowering each of the plurality of first roller portions 410 in the vertical direction (i.e., the Z-axis direction) by using the first lifting portion 60. Accordingly, as the rear wheel 13 supported by the plurality of second rollers 510 also rises and falls, the rider R may enjoy indoors a dynamic experience such as riding uphill or downhill.

Figure 8A:
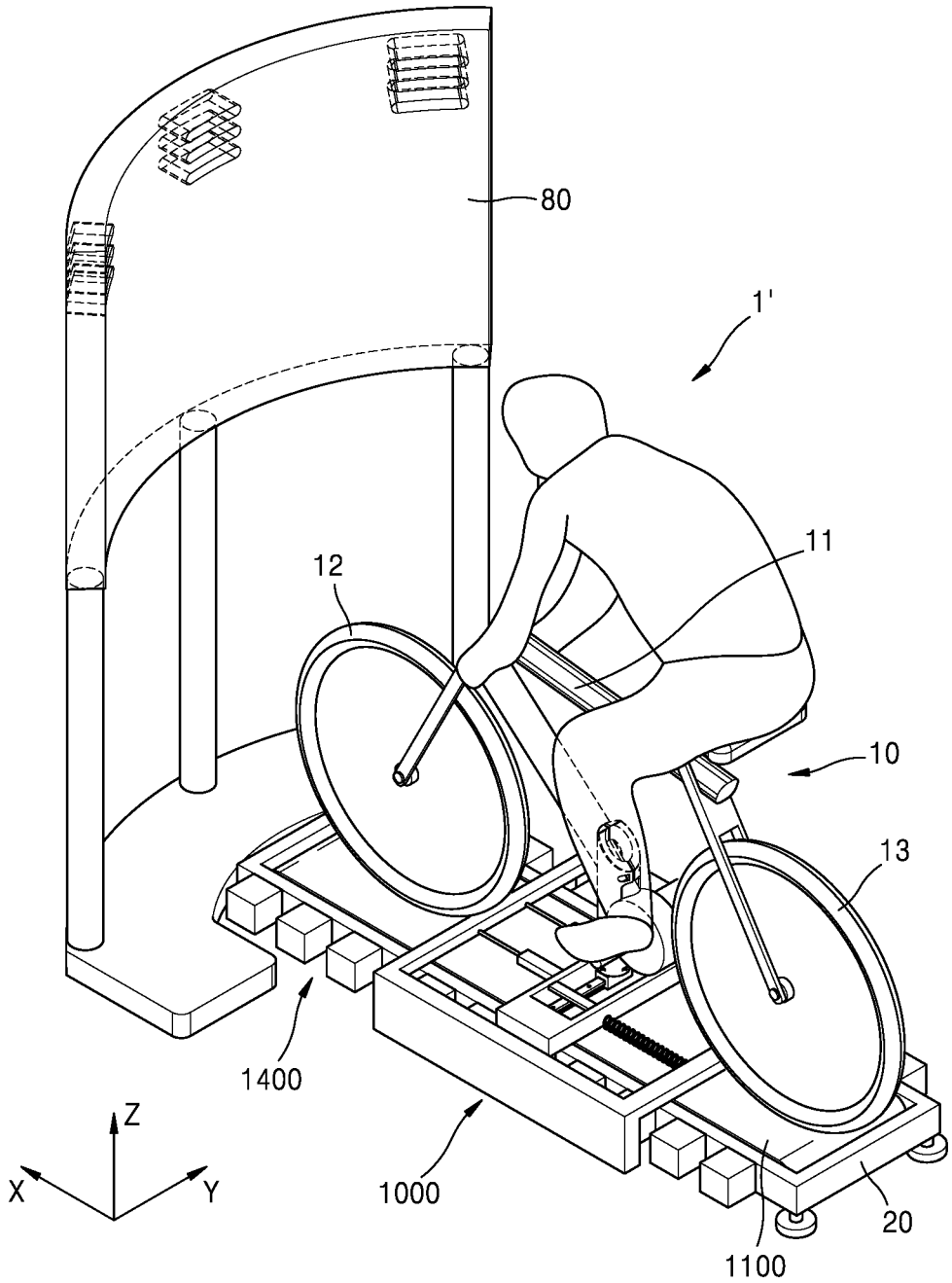
FIG. 8A is a perspective view of a bicycle simulator according to an embodiment of the disclosure.
Figure 8B:
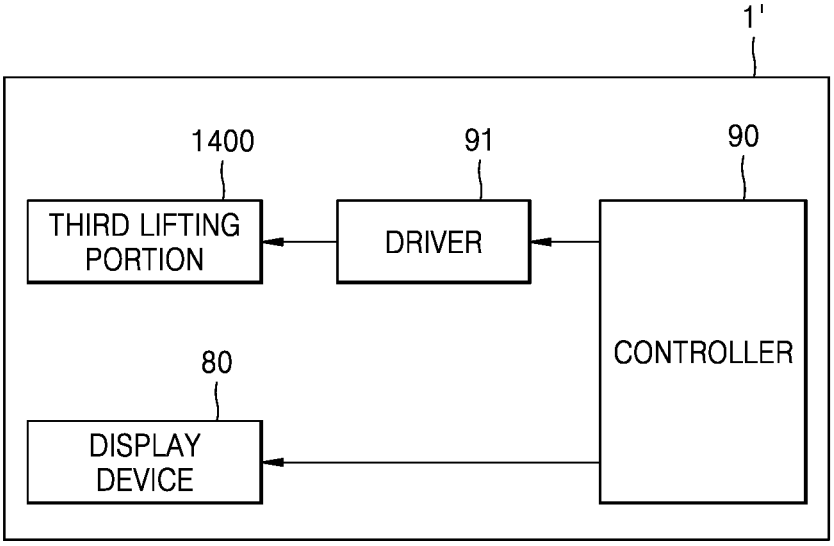
FIG. 8B is a schematic block diagram of a bicycle simulator according to an embodiment of the disclosure.
Figure 9:
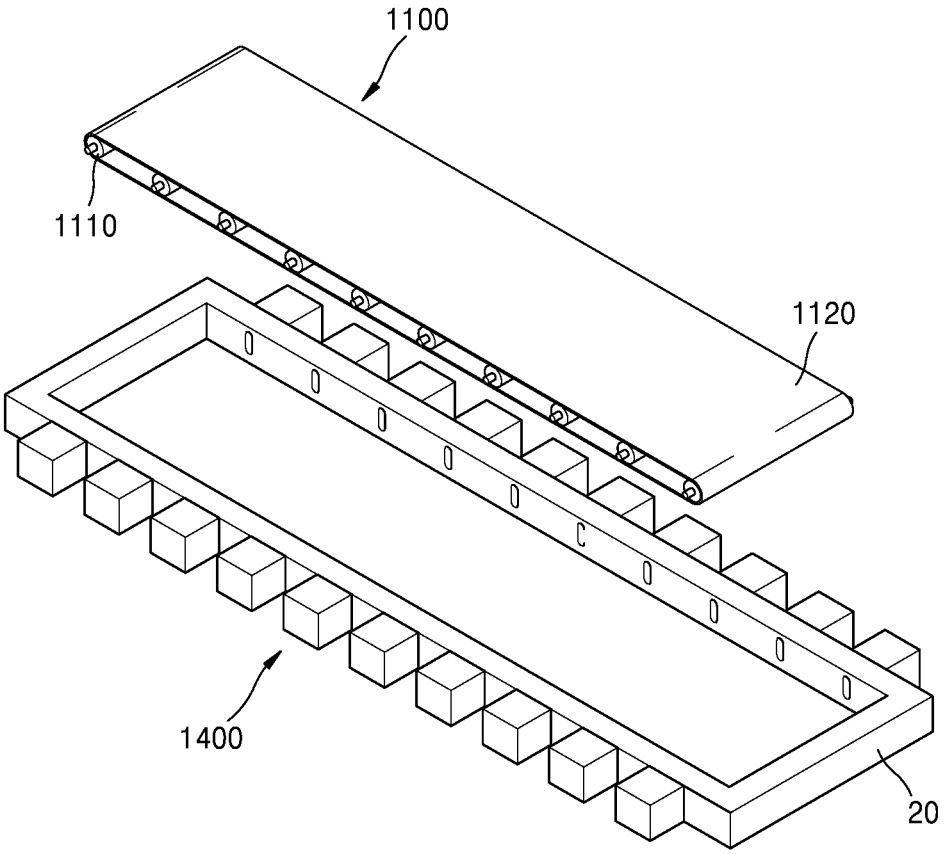
FIG. 9 is an exploded perspective view of a bicycle simulator according to an embodiment of the disclosure.
Figure 10:
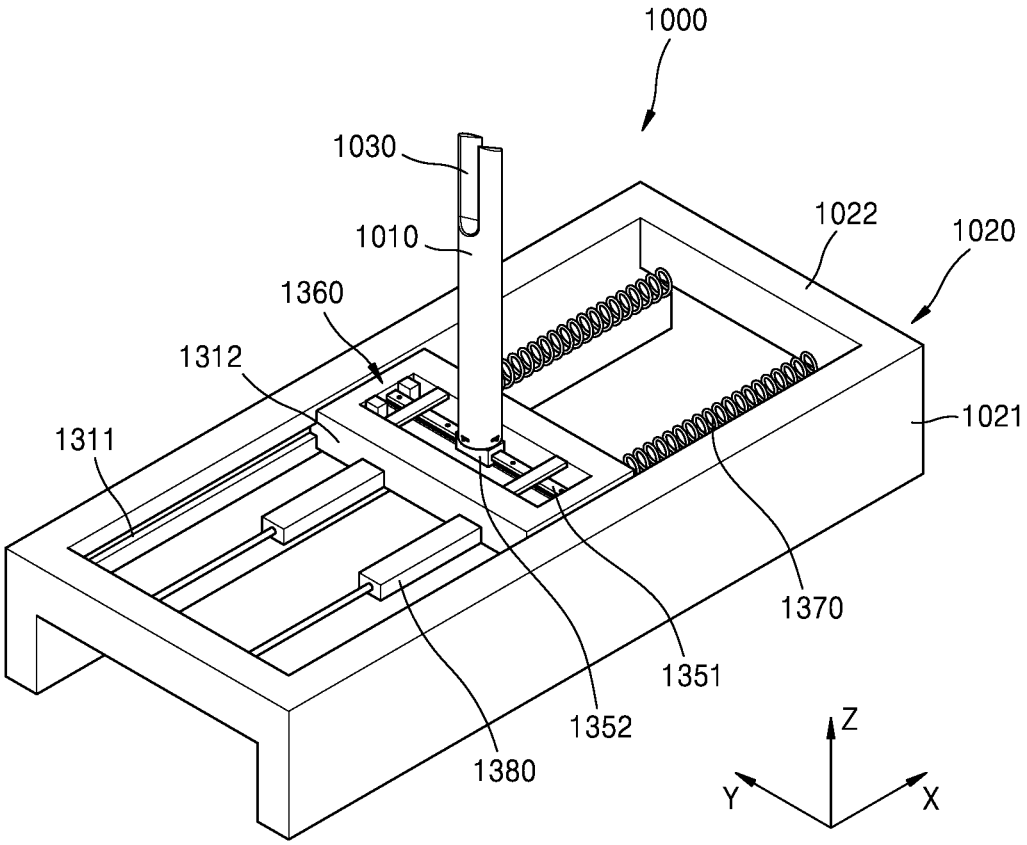
FIG. 10 is a perspective view of a frame support portion according to an embodiment of the disclosure.

FIG. 8A is a perspective view of a bicycle simulator according to an embodiment of the disclosure. FIG. 8B is a schematic block diagram of a bicycle simulator according to an embodiment of the disclosure. FIG. 9 is an exploded perspective view of a bicycle simulator according to an embodiment of the disclosure. FIG. 10 is a perspective view of a frame support portion according to an embodiment of the disclosure.

A bicycle simulator 1' according to an embodiment of the disclosure may include a base portion 20, a frame support portion module 1000, a third treadmill 1100, and a third lifting portion 1400. For convenience of description, a description of a configuration substantially the same as the configuration in the embodiment described above will be omitted.

Referring to FIGS. 8A to 9, the base portion 20 according to an embodiment of the disclosure is a support member fixed to the ground to support a bicycle 10. As an example, the base portion 20 may be provided to have a frame shape on which the third treadmill 1100 to be described below may be seated, for example, a rectangular frame shape extending in one direction. However, the disclosure is not limited thereto, and an arbitrary support member on which the third treadmill 1100 may be seated may be provided.

The third treadmill 40 is a support member that supports a front wheel 12 and a rear wheel 13 of the bicycle 10 mounted on the bicycle simulator 1' and rotates according to the rotations of the front wheel 12 and the rear wheel 13. As an example, the third treadmill 1100 may include a plurality of third roller portions 1110 arranged to be apart from each other with a certain interval therebetween in a running direction (i.e., an X-axis direction) of the bicycle 10, a third belt 1120 disposed to surround the outer circumferential surfaces of the plurality of third roller portions 1110 and rotating in an endless track, and a plate-shaped deck (not shown) disposed between the plurality of third roller portions 1110 and capable of supporting the loads of the front wheel 12 and the rear wheel 13. Both ends of each of the third roller portions 1110 may rotate by forming an axial coupling to the base portion 20, and may move in a direction (i.e., a Z-axis direction) perpendicular to the running direction (i.e., the X-axis direction) of the bicycle 10 with respect to the base portion 20.

Referring to FIGS. 8A and 10, the frame support portion module 1000 according to an embodiment is a support member for stably fixing the position of the bicycle 10 by supporting a bicycle frame 11. As an example, the frame support portion module 1000 may include a support bar 1010, a frame base 1020, and a support clamp 1030.

The support bar 1010 is a support member in the shape of a straight rod extending in one direction. As an example, one end of the support bar 1010 may be disposed to be fixed to a fourth slide portion 1352, which is described below, and may move in a left-right direction (i.e., a Y-axis direction) together with the fourth slide portion 1352. In addition, the support clamp 1030 may be disposed at the other end of the support bar 1010 to support the bicycle frame 11.

The frame base 1020 is detachably disposed on the base portion 20 and is a frame member capable of supporting the support bar 1010. As an example, the frame base 1020 may include a frame 1022 on which a third slide guide 1311 and a fourth slide guide 1351 to be described below may be seated, for example, a rectangular frame shape extending in one direction. However, the disclosure is not limited thereto, and an arbitrary support member on which the third slide guide 1311 and the fourth slide guide 1351 may be seated may be provided. In addition, the frame base 1020 may include a side support portion 1021 that is detachably supported by the base portion 20. The side support portion 1021 may be disposed on a side surface of the frame 1022 and may extend in a vertical direction (i.e., a Z-axis direction) that is an up-down direction. The side support portion 1021 may be detachably supported from a side portion 21 of the base portion 20, and in this case, the frame 1022 may be disposed on the third treadmill 1100.

The frame support portion module 1000 according to an example may further include a third slide guide 1311 disposed on both sides of the frame base 1020 and extending in the running direction (i.e., the X direction) of the bicycle 10, and a third slide portion 1312 by which the support bar 1010 is supported, the third slide portion 1312 being connected to the third slide guide 1311 to be slidable along the third slide guide 1311.

The frame support portion module 1000 according to an example may further include a fourth slide guide 1351 supported by the frame base 1020 for movement in the left-right direction (i.e., the Y-axis direction) of the support bar 1010 and extending in the left-right direction (i.e., the Y-axis direction), and a fourth slide portion 1352 fixed to one end of the support bar 1010 and connected to be slidable along the fourth slide guide 1351.

The frame support portion module 1000 according to an example may further include a movement interval detector 1360 capable of detecting and tracking a movement interval generated as the fourth slide portion 1352 moves along the fourth slide guide 1351.

The frame support portion module 1000 according to an example may further include an elastic member 1370 having one end supported by the frame base 1020 and the other end supported by the third slide portion 1312, and a damper member 1380 having one end supported by the frame base 1020 and the other end supported by the third slide portion 1312.

The third slide guide 1311, the third slide portion 1312, the fourth slide guide 1351, the fourth slide portion 1352, the movement interval detector 1360, the elastic member 1370, and the damper member 1380, described above, are substantially the same as the first slide guide 311, the first slide portion 312, the second slide guide 351, the second slide portion 352, the movement interval detector 360, the elastic member 370, and the damper member 380, and thus, descriptions thereof will be omitted.

As described above, the frame support portion module 1000 according to an embodiment is supported so as to be replaceable on the base portion 20 including the third treadmill 1100, and thus may be disposed to be compatible not only with a treadmill integrally implemented with the frame support module 1000 but also with treadmills of different models, thereby improving user convenience.

Figure 11:
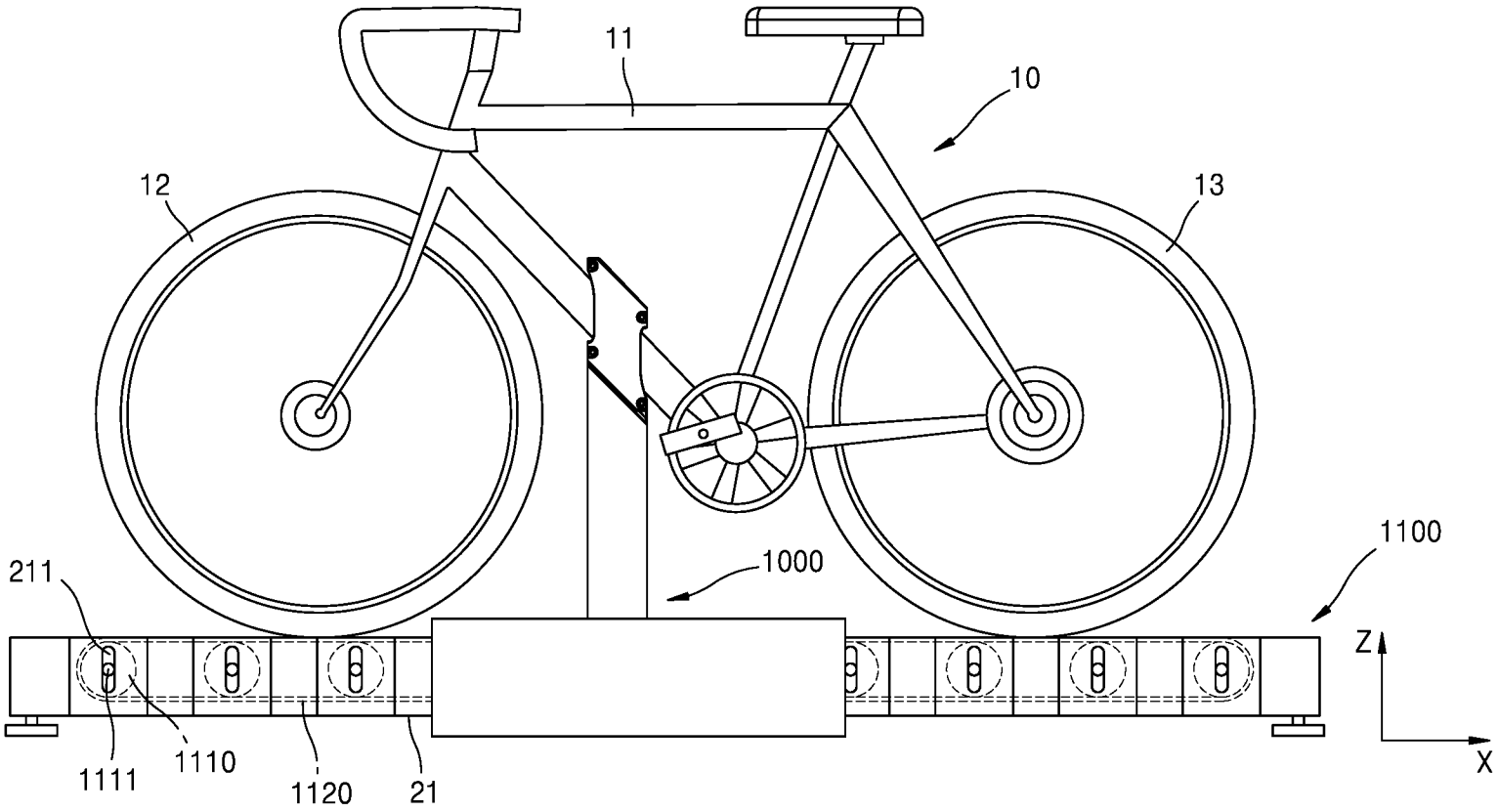
FIG. 11 is a side view of a bicycle simulator according to an embodiment of the disclosure.
Figure 12A:
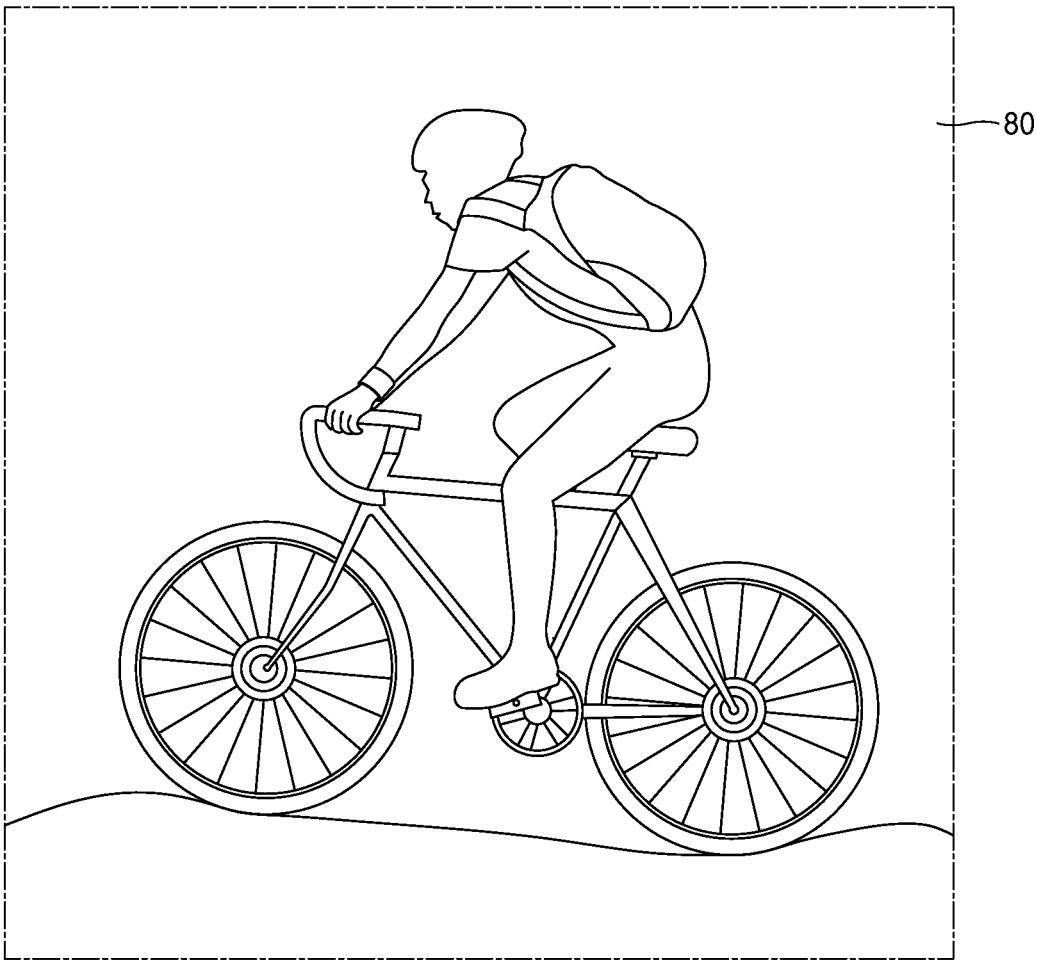
FIG. 12A is a schematic diagram of a display device on which a driving scene having an inclined portion is displayed, according to an embodiment of the disclosure.
Figure 12B:
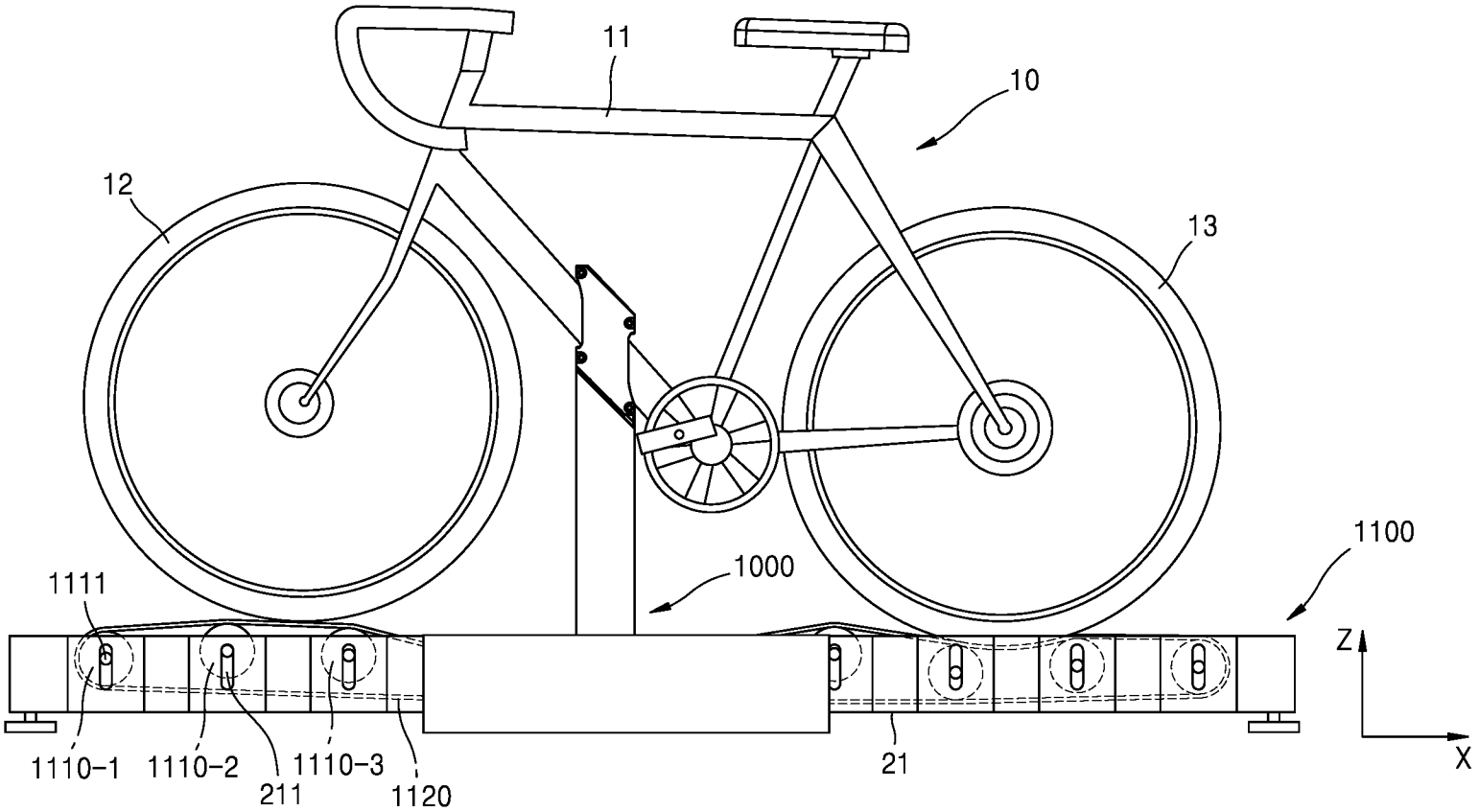
FIG. 12B is a side view of a bicycle simulator according to an embodiment of the disclosure.

FIG. 11 is a side view of a bicycle simulator according to an embodiment. FIG. 12A is a schematic diagram of a display device on which a driving scene having an inclined portion is displayed, according to an embodiment of the disclosure. FIG. 12B is a side view of a bicycle simulator according to an embodiment.

Referring to FIGS. 8 and 11, a third lifting portion 1400 according to an embodiment is a driving device capable of raising or lowering, in a vertical direction (i.e., a Z-axis direction) that is an up-down direction, a support shaft 1111 included in a plurality of third roller portions 1110. Because the third lifting portion 1400 is substantially the same as the first lifting portion 60 described above, descriptions thereof will be omitted for convenience of description.

Referring to FIG. 12B, a display device 80 may display the appearance of the rider R riding uphill and downhill paths. As an example, such a riding path may be implemented as a mountain riding path. In this case, after the controller 90 recognizes a riding road state implemented in the display device 80, the controller 90 may operate the driver 91 to respond to a riding situation. Accordingly, as shown in FIG. 12C, a support shaft 1111 may rise in the vertical direction (i.e., the Z-axis direction), and thus, one or more of a plurality of third roller portions 1100, for example, a third-second roller portion 1110-2 and a third-third roller portion 1110-3, may rise in the vertical direction (i.e., the Z-axis direction). In this case, the rider R may move forward in a running direction (i.e., an X-axis direction) of a bicycle 10 by riding at an increased speed. Accordingly, the bicycle 10 in which a front wheel 12 is supported by the third-second roller portion 1110-2 and the third-third roller portion 1110-3 may also rise in the vertical direction (i.e., the Z-axis direction), and thus, the rider R may enjoy indoors a dynamic experience such as actually riding uphill.

In the foregoing descriptions, particular embodiments of the disclosure have been described and illustrated, but the disclosure is not limited to the embodiments described above. It will be apparent to those skilled in the art that various modifications and variations may be made without departing from the spirit and scope of the disclosure. Therefore, such modifications or variations should not be individually understood from the technical spirit or point of view of the disclosure, and modified embodiments should be said to belong to the claims of the disclosure.

The invention claimed is:

1. A bicycle simulator comprising:

a base portion having a rectangular frame shape;

a frame support portion module detachably supported by the base portion; and a treadmill having a belt, seated on the base portion along the rectangular frame shape and extending in a running direction of a mounted bicycle, wherein the belt is configured to support a front wheel and a rear wheel of the mounted bicycle, and rotate according to rotation of the front wheel and the rear wheel, wherein the frame support portion module includes:

a frame base having a frame and two side support portions disposed on two side surfaces of the frame;

a first slide guide disposed on each of the two side portions of the frame base and extending in the running direction of the mounted bicycle;

a first slide portion connected to and movable along the first slide guide, wherein the first slide portion is inserted into the first slide guide to move in the running direction of the mounted bicycle;

a second slide guide supported by the first slide portion and extending in a left-right direction perpendicular to the running direction of the mounted bicycle;

a second slide portion connected to and movable along the second slide guide;

a support bar extending upward from the second slide portion, the support bar having a first end and an opposite second end, wherein the first end of the support bar is fixed to the second slide portion; and a support clamp disposed at the second end of the support bar and configured to support a bicycle frame of the mounted bicycle by fixing at least one of a down tube and a top tube of the bicycle frame.

2. The bicycle simulator of claim 1, wherein the treadmill further includes:

a plurality of roller portions disposed to be apart from each other with a predetermined interval therebetween in the running direction of the mounted bicycle, wherein the belt is disposed to surround outer circumferential surfaces of the plurality of roller portions, and wherein the frame support portion module is disposed over the belt.

3. The bicycle simulator of claim 2, further comprising a plurality of lifting portions disposed on each of the plurality of roller portions, wherein the plurality of lifting portions are disposed at both ends of the plurality of roller portions, and move the plurality of roller portions up and down in a vertical direction perpendicular to the running direction of the mounted bicycle.

4. The bicycle simulator of claim 3, further comprising:

a display device that visually provides a riding environment to a rider on the mounted bicycle; and a controller that controls driving of the plurality of lifting portions, wherein the controller raises or lowers each of the plurality of roller portions to match the riding environment provided in real time through the display device.

* * * * *